US007124968B2

(12) United States Patent
Oder et al.

(10) Patent No.: US 7,124,968 B2
(45) Date of Patent: Oct. 24, 2006

(54) METHOD AND APPARATUS FOR SEPARATING MATERIAL

(75) Inventors: Robin R. Oder, Export, PA (US); Russell E. Jamison, Lower Burrell, PA (US)

(73) Assignee: EXPORTech Company, Inc., New Kensington, PA (US)

( * ) Notice: Subject to any disclaimer, the term of this patent is extended or adjusted under 35 U.S.C. 154(b) by 0 days.

(21) Appl. No.: 10/988,367

(22) Filed: Nov. 12, 2004

(65) Prior Publication Data

US 2005/0145732 A1 Jul. 7, 2005

Related U.S. Application Data

(63) Continuation of application No. 09/514,048, filed on Feb. 25, 2000, now Pat. No. 6,820,829.

(51) Int. Cl.
*B02C 19/12* (2006.01)

(52) U.S. Cl. ..... 241/18; 241/24.24; 241/24.31

(58) Field of Classification Search ..... 44/620, 44/627; 241/18, 24.24, 24.31
See application file for complete search history.

(56) References Cited

U.S. PATENT DOCUMENTS 3,908,912 A * 9/1975 Irons et al. ..... 241/20
4,113,187 A * 9/1978 Hoppen et al. ..... 241/19
4,389,019 A * 6/1983 Adrian et al. ..... 241/19

* cited by examiner

*Primary Examiner*—Mark Rosenbaum
(74) *Attorney, Agent, or Firm*—Ansel M. Schwartz

(57) ABSTRACT

An apparatus for sorting particles composed of a mixture of particles with differing physical and chemical characteristics. The apparatus includes a comminutor, a mechanism for removing particles from the inside of the comminutor which are intermediate in size between the feed to the comminutor and the product of comminution, a mechanism for either discharging particles taken from the comminutor to a reject stream or providing them to a size classification apparatus such as screening, a mechanism for returning the oversize particles to the comminutor or for discharging them to the reject stream, an electric mechanism for separating particles with an electrical force disposed adjacent to a magnet mechanism, a mechanism for providing the particles to the magnet mechanism and the electric mechanism and for providing triboelectric and capacitive charges to the particles, and a mechanism for returning one of the products of electric and magnetic separation to the comminutor while discharging the other to the reject stream. A method for sorting particles composed of a mixture of particles with differing physical and chemical characteristics.

9 Claims, 19 Drawing Sheets

METHOD AND APPARATUS FOR SEPARATING MATERIAL

This application is a continuation of U.S. application Ser. No. 09/514,048 filed Feb. 25, 2000, now U.S. Pat. No. 6,820,829.

This invention was made with Government support under Grant DE-FG05-94ER81764 awarded by the Department of Energy. The Government has certain rights in this invention.

FIELD OF THE INVENTION

The invention is in the field of physical separation of particulate matter. Specifically, the invention relates to the operation of a comminution device as a size reducing device, as concentrator, and as a separator of less friable particles liberated from the feed matrix in the grinding operation. More specifically, the invention is in the field of physical separation of particles removed from the comminution device to recover desirable particles from return to the comminution device.

BACKGROUND OF THE INVENTION

Comminutors are employed to reduce the size of particles to a range which is desirable and to liberate impurities so that they can be removed downstream of comminution. The feed particles may range in size up to several inches while the product particles may range from inches down to microns in size. More comminution energy is required to bring a mixture of particles of widely ranging friabilities to the desired size consist than when the friable components alone are present. The invention relates to reducing comminution energy consumption and increasing the throughput of comminutors while improving the quality of the product of comminution by separating the friable and less friable components as they are liberated from the feed matrix within the grinding operation and before the hard component is overground. Specifically, the invention relates to modification and operation of comminuting devices and their classifiers, if they are used, so as to separate two streams from the comminution device. One is concentrated in the hard and less friable components liberated from the feed in the grinding operation. This may be either an impurity or a valuable component of the feed. The other is concentrated in the friable component of the feed. More specifically, the invention relates to combining the operation of a comminution device and a separation device so as to separate the hard components of the feed as they are liberated inside the comminutor but before they are overground. Separation methods based on gravity, size classification, dry magnetic separation, and triboelectric means are used to separate hard material form friable material found in a mill concentrated steam taken from the comminution device. Particulate matter of differing chemical and physical makeup can have different magnetic properties and may be electrically charged by contact and friction, tribocharging. By including triboelectric separation means, modified dry magnetic separators can be effective in recovering friable material of a great range of types from the mill concentrated fraction taken from the mill. By this combined pulverizer-separator operation, the MagMill™ can produce high quality comminution products without significant loss of the desired component. The friable material so separated is returned to the grinding zone for grinding to product fineness while the hard component is collected separately and not returned to the mill. By this means, both the quality and the recovery of the separated components are improved when compared to that of the state-of-the-art technology in which everything is reduced to the same size consist and then separated downstream of the comminution device.

The invention is distinguished from the state-of-the-art by processing a significant amount of the particles circulating inside the comminution device. In current technology, tramp iron exits are employed to separate very small amounts of hard and abrasive material before it destroys the inside of the grinding device. The rate of withdrawal of this undesirable material is typically less than 1/10% of the rate of feed to the comminutor. The desired goal is protection of the grinding device, not improvement of the quality of the product or increasing throughput and decreasing power draw. By contrast, the present invention preferentially extracts material from the inside of the comminutor which is concentrated in hard components of the feed. Indeed, if it is desired to improve the quality of the product, then the amount of material to be separated from the inside of the comminutor must be sufficient to have an effect. One tenth of one percent, generally, is not enough. The required amount is dependent upon the concentration of hard components in the withdrawn material and the recovery of more friable material from this stream which is subsequently returned to the comminutor for grinding to size specification. The present invention is unique in showing how and where to withdraw this material from the comminutor and in employing unique and powerful methods for recovery of the friable component inadvertently withdrawn from the internally circulating stream inside the comminutor.

Indeed, it has been discovered that particles of quality the same as or worse than that withdrawn from the tramp metal chutes can be withdrawn from the inside of a coal pulverizer at locations several feet above the throat area where air enters and tramp metal exits. This has been observed in grinding a blend of raw coals from North Central Pennsylvania in an ABB C.E. Raymond 633 bowl mill. For this mill, coal was withdrawn from the pyrite trap at the rate of 67 pounds per hour. This is small compared to the nominal 12–15 TPH fed to the pulverizer. The coal withdrawn from the pyrite traps had an ash level of 69.1 Wt. % and a sulfur level of 23.4 Wt. %. In the experimental tests, coal was withdrawn at the rate of 8.2 Lb/Hr from a sampling port located several feet above the top of the grinding bowl in the region which is open for air flow upward. While the particle size was smaller than that withdrawn from the pyrite traps, it had an ash level of 58.1 Wt. % and a sulfur level 33.6 Wt. %. This illustrates the potential for separation of refuse quality material from the flow of particles inside the pulverizer.

By way of example, coal is dry-milled to 200 mesh (74 micron) topsize at pulverized-coal fired power plants to promote good combustion characteristics. [See, for example, *Steam, Its Generation and Use*, Chapter 9, "Preparation and Utilization of Pulverized Coal," Babcock & Wilcox, New York, N.Y., 1978, and *Combustion Fossil Power Systems, A Reference Book on Fuel Burning and Steam Generation*, Ed., Joseph G. Singer, Chapter 12, "Pulverizers and Pulverized-Coal Systems," Combustion Engineering, Inc., Windsor, Conn. 1981, incorporated by reference herein]. The fine coal generated in the pulverizer is air-conveyed out of the mill directly to the burner. Coincidentally, grinding to 200 mesh is also effective in liberating fine minerals encased in the feed-coal particles even after the coal has been cleaned using conventional wet processing technology. However, other than tramp iron chutes called pyrite traps for removing small amounts of pyrites and other coarse debris, no means are employed in the coal pulverizers now used to separate minerals which are liberated there. Separation of hard minerals at the pulverizer would improve operation of the power plant by increasing the pulverizer throughput and reducing the power draw, by reducing abrasive wear, by reducing slagging, fouling, and water wall wastage in the furnace, by reducing emissions of sulfur and other hazardous air pollutants such as trace metals associated with minerals in the coal, including mercury, and arsenic which is deleterious to the operation of catalytic scrubbers used in post combustion separation of sulfur and nitrogen oxides.

The bulk of the hydrocarbon structure of bituminous coals is much softer than the minerals commonly found in coal. Consequently, hard minerals require more passes through the mill's grinding zone to reach product size specification (70% to 80% finer than 74 microns particle diameter) than does the soft coal. Because of this, the concentration of hard minerals is greater in the stream of oversize particles circulating inside the pulverizer (internal circulation) than it is in the feed coal. Iron pyrite, one of these minerals, is one of the hardest and most abrasive minerals commonly found in coal. Trace metals such as mercury, arsenic, and selenium are known to preferentially associate with iron sulfide minerals such as pyrites. Consequently, removal of refuse concentrated in the mill circulation can significantly lower the ash, sulfur, and trace metal levels in the mill product.

The logical place for fine coal cleaning is in the pulverizers, which are already used by the power plant. Indeed, EXPORTech Company, Inc. (Y. Feng, R. R. Oder, R. W. DeSollar, E. A Stephens, Jr., G. F. Teacher and T. L. Banfield, "Dry Coal Cleaning in a MagMill, appearing in the Proceedings of the 22$^{nd}$ International Technical Conference on Coal Utilization and Fuel Systems," Clearwater, Fla., Mar. 16–19, 1997; See also R. R. Oder, R. E. Jamison, and E. D. Brandner, "Preliminary Results of Pre-Combustion Removal of Mercury, Arsenic, and Selenium from Coal by Dry Magnetic Separation," appearing in the Proceedings of the 24$^{th}$ International Technical Conference on Coal Utilization & Fuel Systems, Clearwater, Fla., Mar. 8–11, 1999, pp. 151–158, incorporated by reference herein) has shown that refuse with high levels of ash and sulfur can be separated from the internal circulation of almost all commercial pulverizers used at power plants and that removal of this refuse from the mill can lower the ash and sulfur levels and reduce the levels of toxic trace elements in the pulverized product. ETCi has further demonstrated that dry magnetic separation can be used to recover clean coal from the refuse (R. R. Oder, R. E. Jamison, and J. R. Davis, "Coal Cleaning at Pulverized-Coal Fired Power Plants," Proc. 11$^{th}$ Annual Pittsburgh Coal Conference—Coal: Energy and the Environment, Sep. 12–16, 1994, Pittsburgh, Pa., Ed., S-H Chiang, pp. 640–645 (1994), incorporated by reference herein). Additionally, ETCi has suggested that the combined process of pulverization, size and density classification in the mill, dry magnetic separation for recovery of clean coal from the mill refuse, plus return of the clean coal to the pulverizer for grinding to product fineness, is a novel method for efficient separation of ash forming minerals, sulfur, and hazardous pollutants from the coal fed to a pulverized-coal fired power plant. This novel method is not practiced in the electric power industry because of the significant engineering challenge associated with removal of a concentrated stream of refuse from the pulverizers. This obstacle has now been overcome and is the basis for the invention disclosed here.

It is important to note that others have used magnetic separation to separate hard gangue material from the feed to pulverizers, which is standard practice in the industry, and some also to recover the value component from the underflow in the pyrite traps or tramp metal chutes employed in most grinding mills. While this material may be blended with the product or returned to the mill for further grinding, these efforts have treated only a small amount of the material fed to the mill. The current invention is greatly different from these past efforts in two major ways. First, large amounts of material are extracted from the internal circulation of the mill from locations other than the tramp iron chutes. Secondly, powerful magnetic separation techniques are employed which have the capability for separation of materials ranging from strongly magnetic to diamagnetic. Indeed, with the addition of triboelectric phenomena (ElectriMag™ Separator co-pending application having Ser. No. 09/289,929 filed on Apr. 14, 1999, incorporated by reference herein), the method is now capable of separating particles based on both magnetic and surface charging characteristics. The present invention goes far beyond the present state-of-the-art. For this reason, the technology is not restricted to conventional applications to separation of strongly magnetic particles from inert materials. With the combined action of the pulverizer to liberate on the basis of differences in friability and the electric/magnetic separation mechanism employed, the technology can be applied to a wide range of important new applications.

Friability generally has to do with the ease with which small particles can be made in a comminutor. More friable particles produce a greater amount of finer particles than do less friable particles. Generally speaking, friability is related to the hardness of the material and to its ability to fracture which is related in a complex way to fundamental physical characteristics such as crack propagation in the solid. (Klaus Schonert, "Aspects of Very Fine Grinding," Chapter 9 in *Challenges in Mineral Processing*, Proceedings of a Symposium honoring Douglas W. Fuerstenau on his 60$^{th}$ birthday, Editors, K. V. S. Sastry and M. C. Fuerstenau, Society of Mining Engineers, Inc., Littleton, Colo., 1989, incorporated by reference herein). Generally the energy to grind a solid to a specified particle size distribution has been related to an index called the Bond Work Index. This is widely used. Values of the Work Index range generally for 1.4 for calcined clay to 135 for mica. Coal of specific gravity 1.63 has a reported index of 11.4 (Chemical Engineers Handbook, Fifth Edition, Edited by Robert H. Perry, and Cecil H. Chilton, McGraw-Hill Book Company, New York, N.Y. 1973, page 8–11, incorporated by reference herein). Those solids with a large Work Index require more energy to grind to a given particle size. This means more time in the comminutor. Particles with lower Work Indices will require less time. The Work Index is a general measure of the tendency of hard to grind materials to concentrate in the internal circulation of comminution devices.

The value, 11.4, listed for coal is relatively high on this scale because coal of density 1.63 has a significant amount of mineral impurities which have higher work indices than does the mineral-free soft coal. Indeed, the grindability of coal is measured by an index which is different from the Bond Work Index. It is called the Hardgrove Grindability Index, (HGI) and is generally restricted to coal. HGI measurements are made when a specified particle size distribution of the coal is placed in a laboratory grinding machine of a standardized design and a specified amount of grinding energy is expended [See *Steam, Its Generation and Use*, Babcock & Wilcox, New York, N.Y., 1978, and *Combustion Fossil Power Systems, A Reference Book on Fuel Burning and Steam Generation*, Ed., Joseph G. Singer, Combustion Engineering, Inc., Windsor, Conn. 1981, incorporated by reference herein]. The amount of material in the product of grinding which is finer than 200 mesh (74 microns particle diameter) is compared with that of a standard coal whose HGI is taken as 100. On this scale, the higher the value, the more friable or easier the coal is to grind. The grindability of coal is a composite property made up of other properties, such as hardness, strength, and fracture for example. A general relationship exists between grindability and rank. Coals that are easiest to grind are found in the medium and low volatile groups. They are decidedly easier to grind than coal of the high volatile bituminous, sub-bituminous, and anthracite ranks. [See *Coal Preparation,* 4$^{th}$ Edition, Edited by Joseph W. Leonard, The American Institute of Mining, Metallurgical, and Petroleum Engineers, Inc. New York, 1979, Page 1–8, incorporated by reference herein].

The effects of coal grindability on pulverizer throughput are described in combustion technology handbooks [See for example *Steam, Its Generation and Use*, Chapter 9, "Preparation and Utilization of Pulverized Coal," Babcock & Wilcox, New York, N.Y., 1978, and *Combustion Fossil Power Systems, A Reference Book on Fuel Burning and Steam Generation*, Ed., Joseph G. Singer, Chapter 12, "Pulverizers and Pulverized-Coal Systems," Combustion Engineering, Inc., Windsor, Conn. 1981, incorporated by reference herein]. The grindabililty is a function of moisture in the coal, its rank, petrographic makeup, and mineral content and types. The effects of petrographic makeup and minerals have not been generally been recognized or used. (R. R. Oder and R. J. Gray, "The Effects of Coal Characteristics on Fine Grinding in a Pitt Mill, Chapter 48, in *Comminution—Theory and Practice*, S. Komar Kawatra, Editor, Society of Mining, Metallurgy, and Exploration, Inc. Littleton Colo., 1992, incorporated by reference herein). Table I shows the effects of ash and sulfur levels on the HGI of a blend of medium and high volatile bituminous rank raw coals being ground in an operating pulverizer in a pulverized coal fired power plant in North Central Pennsylvania. The "Pulverizer Concentrated Sample" is material withdrawn from the internal circulation of the pulverizer. It has significantly higher levels of ash and sulfur than the pulverizer feed and a significantly lower value of HGI. The increased sulfur in the "Pulverizer Concentrated Sample" is caused by increased concentration of iron pyrite in the sample. The "Magnetic Separator Reject" material is reject material taken from the "Pulverizer Concentrated Sample" by a dry magnetic separator of the type described in this patent. It is discarded from the pulverizer.

TABLE I

Effects of Ash and Sulfur Concentrations on HGI for a blend of North Central Pennsylvania Bituminous Coals Sampled at Various Points in a MagMill ™

| Sample | HGI | Ash | Sulfur |
|---|---|---|---|
| Pulverizer Feed | 63 | 14.4 | 2 |
| Pulverizer Concentrated Sample | 58 | 33.6 | 11 |
| Magnetic Separator Reject | 57 | 48.7 | 9 |

It is apparent that there are mineral impurities in the coal which can be removed from the internal stream circulating inside the pulverizer which have high concentrations of ash and sulfur and which adversely affect the grindability of the coal.

Effects of Hard Particles on Power Consumption and Throughput of a Coal Pulverizer Separation of the particles of high levels of ash and sulfur from the internal circulation of a pulverizer will increase the effective grindability of the particles in the grinding zone. This has the effect of increasing the throughput and reducing the grinding energy of the pulverizer. This has been observed in grinding an Upper Freeport seam coal from North Central Pennsylvania. The coal was ground in a nominal 1½ ton per hour (TPH) pilot ring/roller pulverizer. A nominal 1½ TPH prototype MagMill™ was made by retrofitting an ElectriMag™ and ParaTrap Magnetic separator of the type described in this patent to the pilot mill. Mill concentrated material taken from the base of the pulverizer was processed. The throughput of the MagMill™ prototype increased to 120% and the grinding energy reduced to 70% of that of the unmodified pulverizer processing the same coal when the iron pyrite content in the product of the MagMill™ had been reduced by nominally 70% and the ash level by 40% with respect to the coal fed to the MagMill™.

Mill Wear

In general, the combination of hard materials, coarse particles, and high velocity are conducive to wear in mills. Extensive data on the wear and cost of various types of steels in ore grinding have been reported (Norman and Loeb, Trans. A.I.M.E., 183, 330, 1949, incorporated by reference herein). Mill wear or abrasion becomes critical on high-peripheral-speed equipment, particularly high-speed close-clearance hammer mills and coal pulverizers of the roller and bowl types low in the mill near the throat. An abrasion index in terms of kW-hr input/Lb of metal lost furnishes a useful indication. Rough values can be found in the Chemical Engineers Handbook, Page 8–10, 1973. Abrasive indices for the 38 materials shown range from 0.0001 for Sulfur, to 0.6905 for Quartzite. Coal is near the low end of the scale and most minerals in coal are near the high end.

Abrasive Wear In Coal Pulverizers. The abrasiveness of coal contributes to operating and maintenance costs at pulverized-coal fired power plants. Areas of high wear are areas inside the pulverizer where coarse particles of high concentrations of ash and sulfur are accelerated by high air velocity entering the mill. This is generally in the base. Abrasive wear is increased many times under the high contact pressure developed between coal and metal in pulverizers. It is important to recognize the relationship between high density coal components found in the lower portions of pulverizers and the wear they cause. This is illustrated in the results of abrasive wear tests made on Eastern US and a Western US raw bituminous rank coal and their specific-gravity fractions which are shown in Table II. These tests show the relationship between the ash levels, abrasive wear, and the specific gravity fractions of the coals. The abrasiveness of raw coals is almost completely due to mineral impurities. [Excerpted from Table 1–19, *Coal Preparation,* 4$^{th}$ Edition, Edited by Joseph W. Leonard, The American Institute of Mining, Metallurgical, and Petroleum Engineers, Inc. New York, 1979, Page 1–51, incorporated by reference herein.]

TABLE II

| | | Results of Abrasion Tests Made on Specific Gravity Fractions of Various Kinds of Coal | | | | | | |
|---|---|---|---|---|---|---|---|---|
| | | | | | | Cumulative | | |
| | | Specific Gravity | Weight % | Ash % | Abrasion Loss, mg | Weight % | Ash % | Abrasion Loss, mg |
| Langley No. 9 | Under | 1.60 | 90.7 | 9.3 | 45 | 90.7 | 9.3 | 45 |
| Christian Co., IL | Over | 1.60 | 9.3 | 58.3 | 1515 | 100.0 | 13.8 | 181 |
| | Total Raw Coal | | | | | | | 234 |
| Anthracite | Under | 1.80 | 81.1 | 7.6 | 63 | 81.1 | 7.6 | 63 |
| Schuylkill Co., PA | Over | 1.80 | 28.9 | 71.8 | 2847 | 100.0 | 19.8 | 589 |
| | Total Raw Coal | | | | | | | 686 |
| Cush Creek | Under | 1.60 | 92.9 | 5.6 | 6 | 92.9 | 5.6 | 6 |
| Indiana Co., PA | Over | 1.60 | 7.1 | 62.1 | 351 | 100.0 | 9.6 | 12 |
| | Total Raw Coal | | | | | | | 12 |
| Montour No. 10 | Under | 1.60 | 79.3 | 9.1 | 43 | 79.3 | 9.1 | 43 |
| Allegheny Co., PA | Over | 1.60 | 20.7 | 75.9 | 618 | 100.0 | 22.9 | 162 |
| | Total Raw Coal | | | | | | | 172 |
| Castle Gate | Under | 1.60 | 95.2 | 6.7 | 147 | 95.2 | 6.7 | 147 |
| Carbon Co., UT | Over | 1.60 | 4.8 | 63.7 | 1517 | 100.0 | 9.4 | 213 |

The abrasive wear attributable to coal is primarily related to the hardness of the minerals in the coal and especially to the quartz and iron sulfides, mainly iron pyrite. The hardness is measured by empirical tests but is closely related to fundamental properties. It is a function of the rank of the coal and varies greatly among the maceral components. The hardness of coal is generally in the range 10–70 kg/mm$^2$ (Vickers Indentation Hardness Test). It has a maximum at 84% carbon (dry mineral free) and a minimum at 90% carbon (dry mineral free) and then increases again. By way of comparison, quartz and pyrite have Vickers hardness numbers of 1100–1260 and 840–1130 respectively and those of hard steels range from 600 to 700, *[Coal Preparation,* 4$^{th}$ Edition, Edited by Joseph W. Leonard, The American Institute of Mining, Metallurgical, and Petroleum Engineers, Inc. New York, 1979, Page 293, incorporated by reference herein.]

SUMMARY OF THE INVENTION

The present invention pertains to an apparatus for sorting particles. The apparatus comprises a first comminution mechanism for releasing particles encases in a solid matrix. The apparatus comprises a first separating mechanism for removing particles from the comminution mechanism. The apparatus comprises a size classification means for separating particles based on their size. The first separating mechanism is engaged with the comminution mechanism and the size classification mechanism. The apparatus comprises a first magnetic means for separating particles with a magnetic force. The apparatus comprises an electric mechanism for separating particles with an electrical force disposed adjacent to the magnet mechanism. The apparatus comprises a first providing mechanism for providing particles to the electric and magnetic separation means. The first providing mechanism is engaged with the size classification mechanism and the electric and magnetic separation means. The apparatus comprises a second magnet mechanism for separating the less magnetic particles separated in the first magnetic mechanism. The apparatus comprises a second mechanism for providing the particles to the second magnet mechanism. The second providing mechanism is engaged with the first and the second magnet mechanisms.

The present invention pertains to a method for sorting particles. The method comprises the steps of comminuting the particles to release particles encased in a solid matrix. Then there is the step of separating the particles from the comminuting device based on the hardness of the particles. Then there is the step of classifying these particles based on size. Then there is the step of charging the undersize particles by contact or by friction and of providing the particles to a first magnet mechanism and electric mechanism disposed adjacent to the magnet mechanism. Then there is the step of separating the particles with the magnetic force from the magnet mechanism and the electric force from the electric mechanism. The method also comprises the steps of providing the less magnetic particles separated in the first magnetic mechanism to a second magnet mechanism. Then there is the step of separating the less magnetic particles with the magnetic force from the second magnet mechanism.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
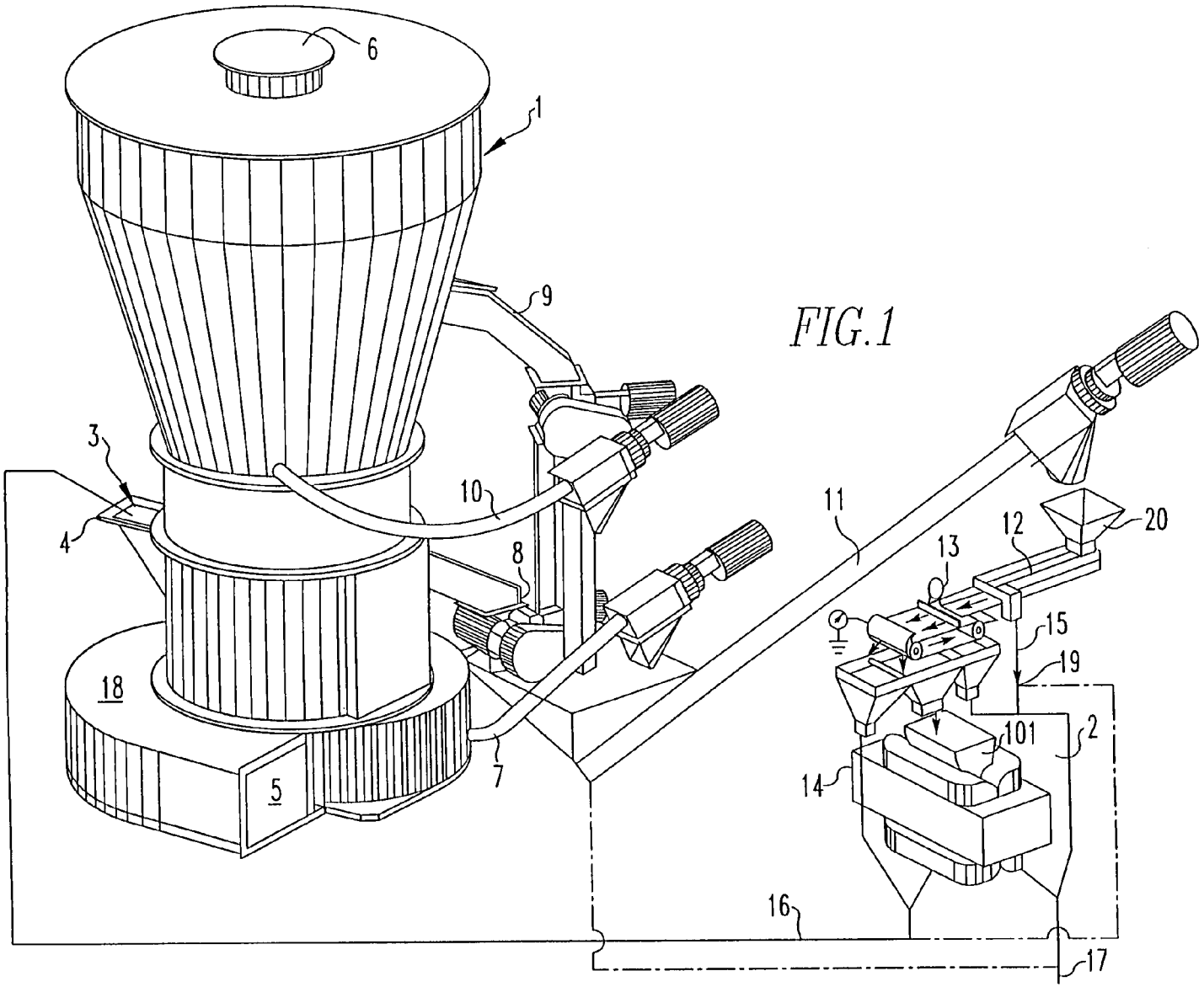
FIG. 1. Schematic representation of a MagMill™.

Referring now to the drawings wherein like reference numerals refer to similar or identical parts throughout the several views, and more specifically to FIG. 1 thereof, there is shown a schematic representation of a MagMill™ pulverizer which consists of an air-swept pulverizer 1 and a separation means 2 working together. Raw feed 3 consisting of a plurality of particles of widely differing sizes with varying degrees of association enters the pulverizer 1 through the mill housing at 4. The largest particle is generally ½ inch to 1 inch in size. The feed can enter the mill from the top as well using means not shown. Air 5 is blown into the base of the mill through air scroll casing 18. Air and particles are conveyed out of the pulverizer at complete opening 6. A portion of the particles which are intermediate in size between that of the feed to the pulverizer and the product are removed from the inside of the mill through removal mechanisms 7, 8, 9, and 10 at intermediate openings. These particles are conveyed 11 to surge bin 20 to the separation means 2. The oversize particles 15 can be conveyed either to the pulverizer for additional grinding 16 or conveyed to reject 17 depending upon the quality of the particles. The product of the separation mechanism is returned to the pulverizer 16 for grinding to size specification. The reject from the separation mechanism is conveyed to refuse 17.

Figure 2:
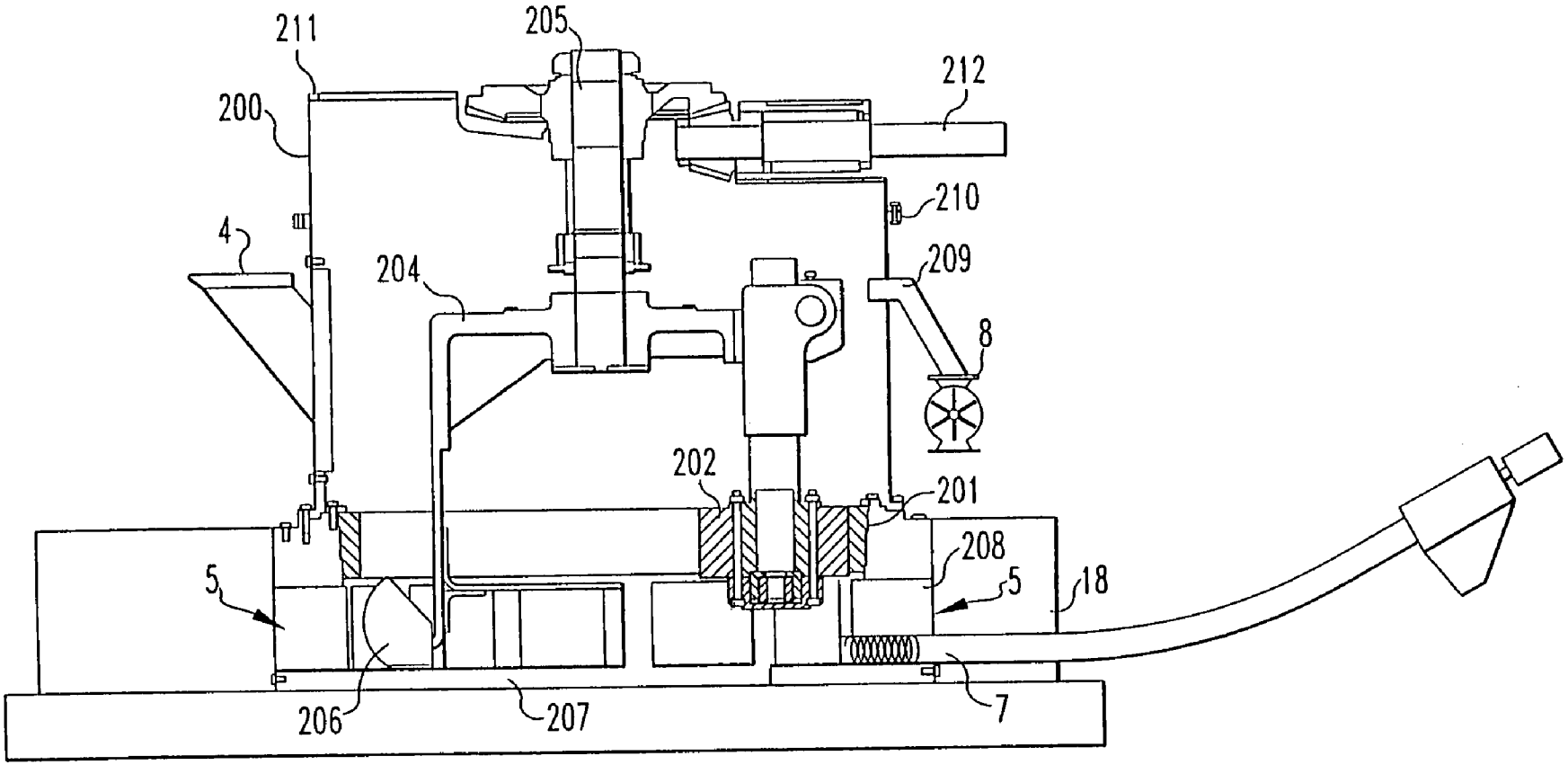
FIG. 2. Schematic representation of the grinding chamber of a ring roller mill.

The grinding chamber 200 inside of the pulverizer is shown in more detail in FIG. 2. In the figure, 201 is a heavy stationary grinding ring. 202 is a rotating roller. The roller is suspended 203 from a rotating crossbar 204 cantilevered from a vertical centered drive shaft 205. Particles are pulverized by compression between the grinding ring 201 and the rotating rollers 202. One roller, 202, is shown in FIG. 2. Mills may employ several rollers. A rotating plow, 206, cantilevered from the center shaft, throws the large, heavy particles which land near the center of the mill base back into the grinding zone between ring and rollers. Particles which are difficult to grind and which are too heavy to be lifted by the air flow, 5, entering the mill base through air flow casing 18 and passing through a plurality of vanes 208 concentrate in the base of the pulverizer 207. Removal mechanism 7 passes through the air scroll casing 18. It opens to the base of the mill inside one the air flow vanes 208. A second removal mechanism 8 enters the grinding chamber at 209 above the elevation of the rotating cross bar 204.

Figure 3:
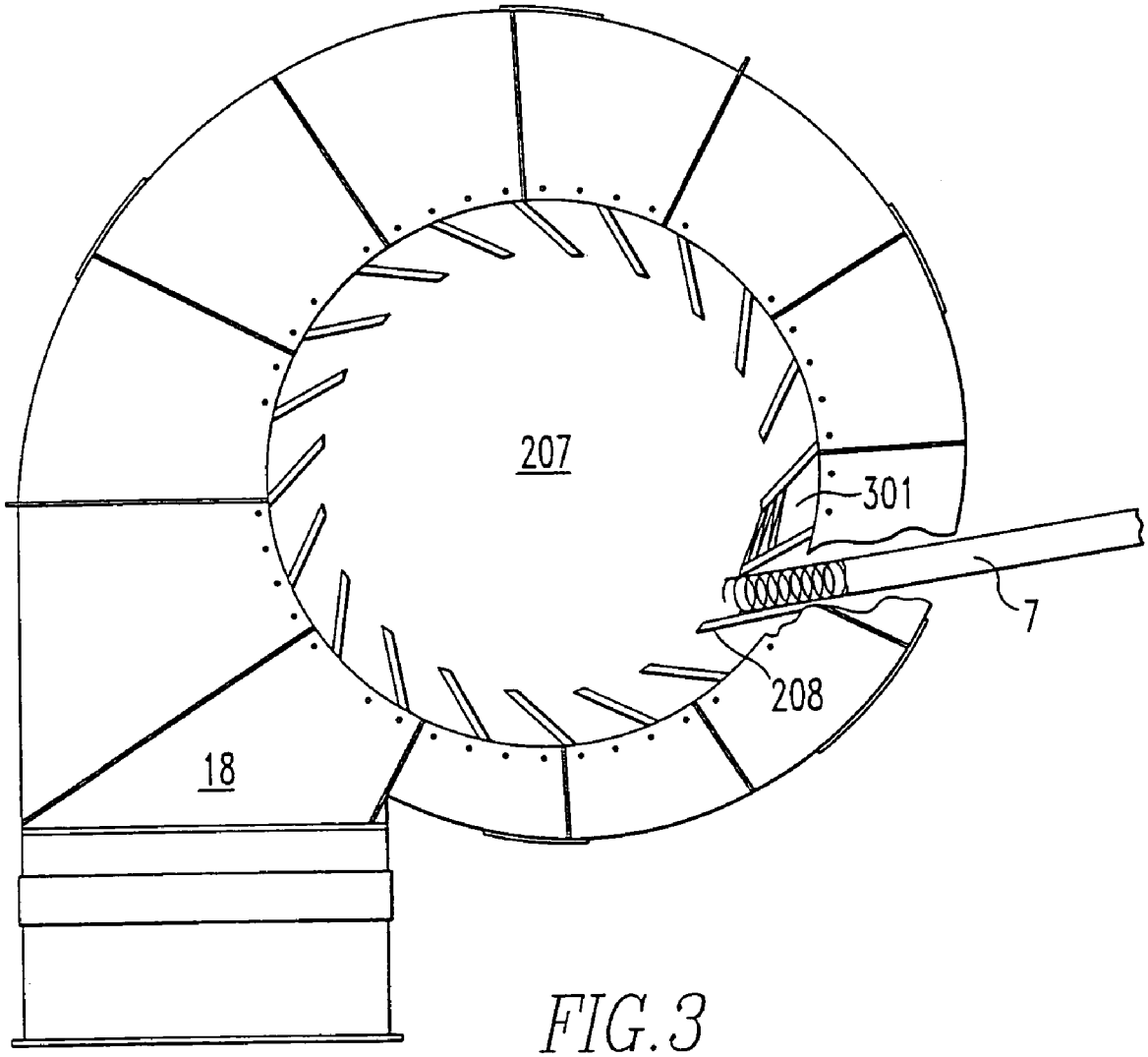
FIG. 3. Schematic representation of the air entrance to the base of a ring roller mill showing screw conveyor.

Hot air 5 is blown into the base of the mill 207 through the air casing 18 shown in FIG. 3. Temperatures up to 250 to 350 degrees Fahrenheit can be used. The air is heated upstream of the air scroll casing by means not shown. The air enters the base of the mill with velocities ranging upward to several thousand feet per minute. The air swirls around the casing and enters the mill through vanes 208 opening underneath the grinding ring 201. The vanes direct the air flow tangential to the inside diameter of the grinding chamber 200. Removal mechanism 7 opens to the mill base in the grinding chamber through vane at 208. It is a screw conveyor of the type manufactured by AFC of Clifton, N.J. The separation mechanism may be located in any air inlet vane around the circumference of the pulverizer but preferentially is located away from the pulverizer inlet 4. The screw conveyor opens just inside the vane without protruding into the base where it would be hit by the plow. The air flow slot 301 immediately upstream of the screw conveyor opening is plugged off to prevent air flow. In operation, this permits buildup of particles in front of the screw conveyor. It is not necessary to employ an air lock device at the exit of the conveyor because air flow is blocked by particles inside the length of the conveyor. The screw conveyor mechanism must be able to operate at the temperature in the base of the pulverizer. More than one separation mechanism 7 may be used in the base of the mill.

Figure 4:
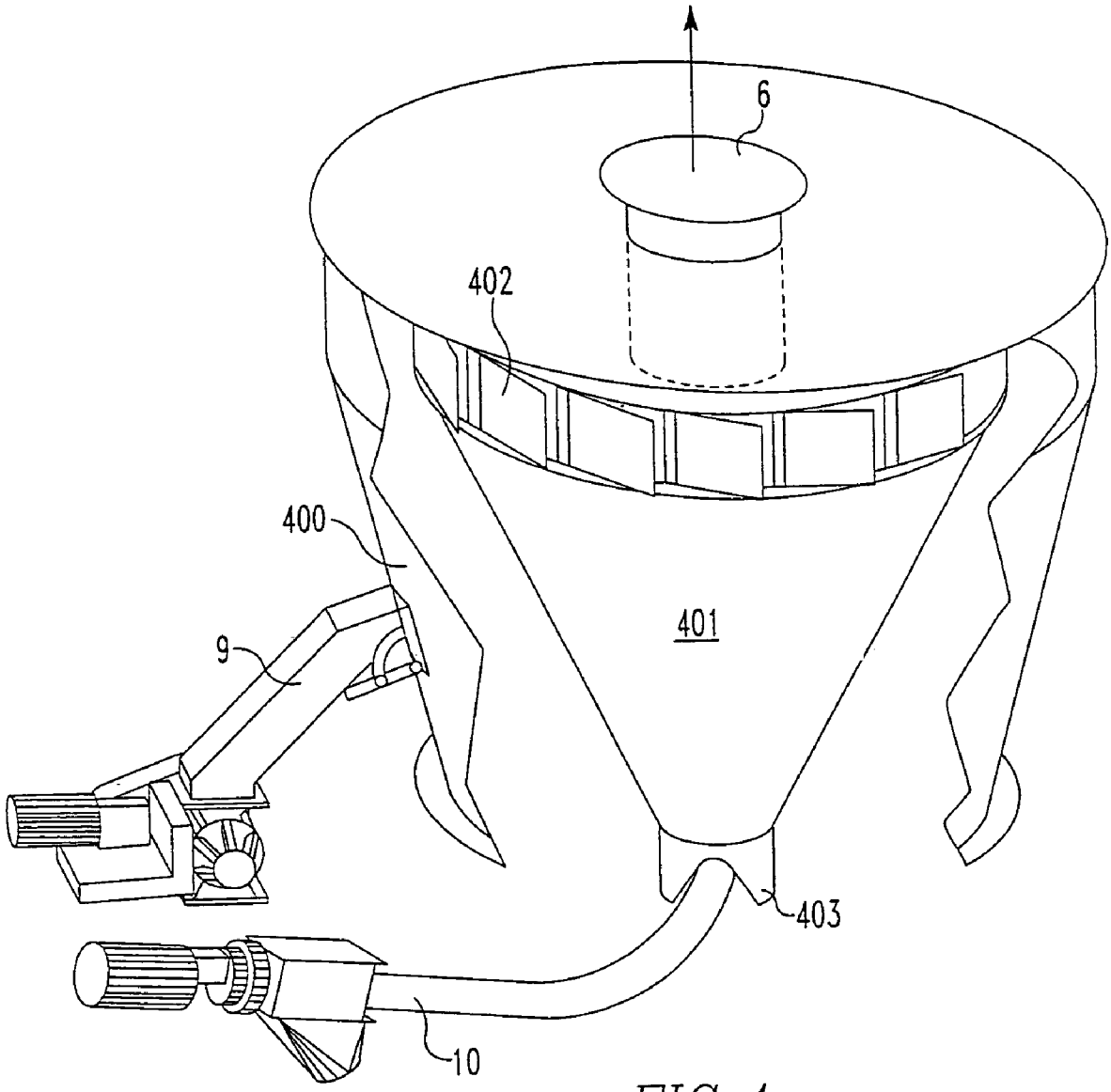
FIG. 4. Schematic representation of a static classifier with sampling apparatus attached.

The inside of the pulverizer at an elevation above the top of the gear train mechanism 211 is shown in FIG. 4. The casing 400 encloses the inverted cone of a static classifier 401. Air and particles passing upward through the mill enter the classifier through vanes 402. Small particles and air exit the pulverizer through the product pipe at 6. Oversize particles drop to the bottom of the inverted cone and return to the grinding chamber 200 through flap valves 403. A separation mechanism 9 is attached to the outside wall of the casing 400. It connects to the inside space between the casing wall and the inverted cone 401. A separation mechanism 10 passes through the casing 400 and is attached to the bottom of the inverted cone at the flap valves 403.

Separation mechanism 8 is a kick-out door. It opens to the inside of the pulverizer chamber at 209. The separation mechanism 8 can be located at any elevation from the top of the roller 202 up to the top of the grinding chamber at 210. It is preferentially at an elevation above or below the rotating arm 204 and at a location around the circumference of the grinding chamber which is away from the feed 4 and the mill drive shaft 212. More than one separation mechanism 8 may be used in the grinding chamber.

Separation mechanism 9 is a kick-out door. It opens into the region of the pulverizer above the top of the gear train mechanism 211 between the casing 400 and the inverted cone 401 of the classifier. It can be located at any elevation from the top of the gear train mechanism 211 up to an elevation below the entrance to the classifier at 402. More than one separation mechanism 9 may be used above the top of the gear train mechanism. It can be located anywhere around the circumference of the classifier.

Figure 6A:
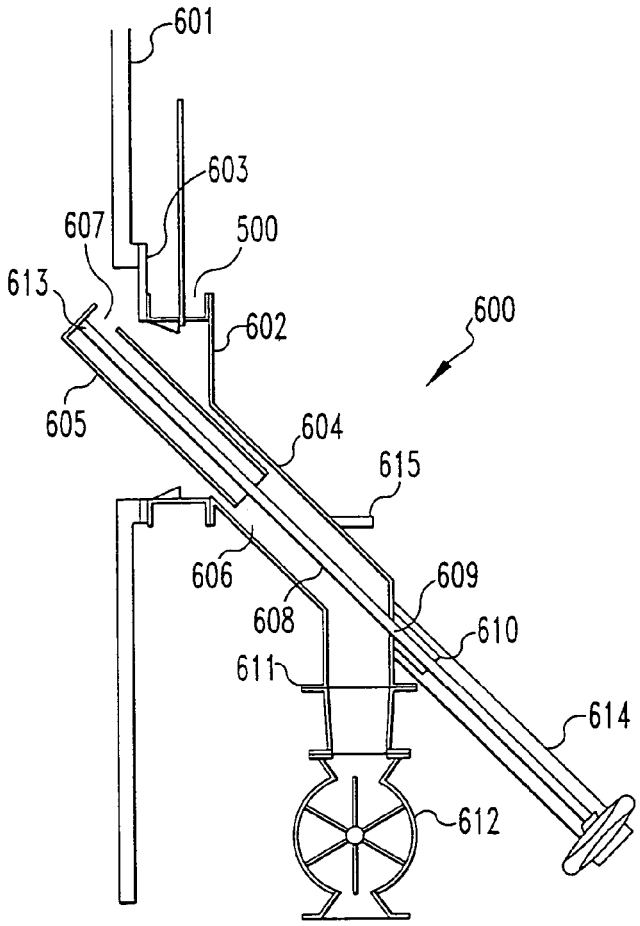
FIG. 6. Schematic representation of a kick-out door mechanism.
Figure 6B:
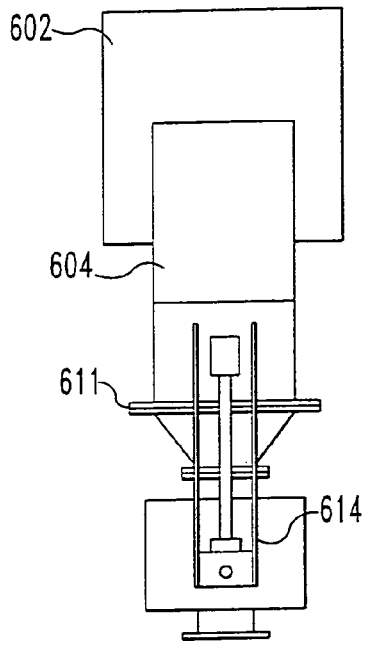
Figure 7:
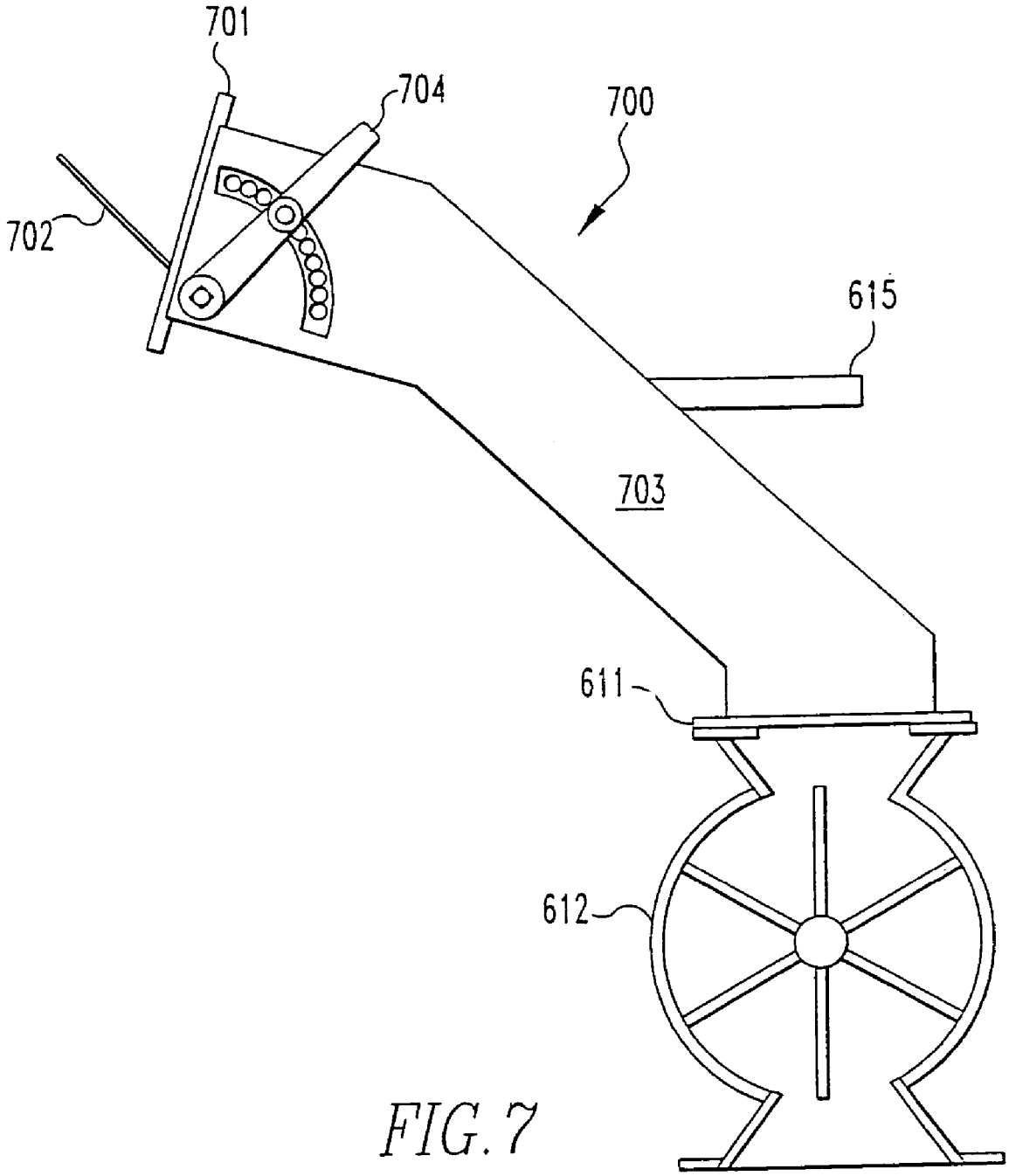
FIG. 7. Schematic representation of an alternative kick-out door mechanism.

The kick-out door mechanism can be as shown in FIG. 6 or FIG. 7. The mechanism 700 shown in FIG. 7 is attached to the pulverizer through mill flange 701. The kick-out door 702 is hinged horizontally so that it opens into the volume of the pulverizer from the bottom edge of the chute 703. Particles which are falling downward inside the pulverizer would be deflected into the chute 703 as shown. Lever 704 is used to open or close the kick-out door 701. The chute 703 is attached to air lock mechanism 705 through air-lock flange 706. The air lock of the type manufactured by W. M. Meyer & Sons, Skokie, Ill., can be operated manually or continuously. The kick-out door mechanism can be hinged horizontally so as to open horizontally from the top or the bottom of the chute or it can be hinged vertically from the left or the right side of the chute so as to open clockwise or counterclockwise as seen from above.

Figure 5:
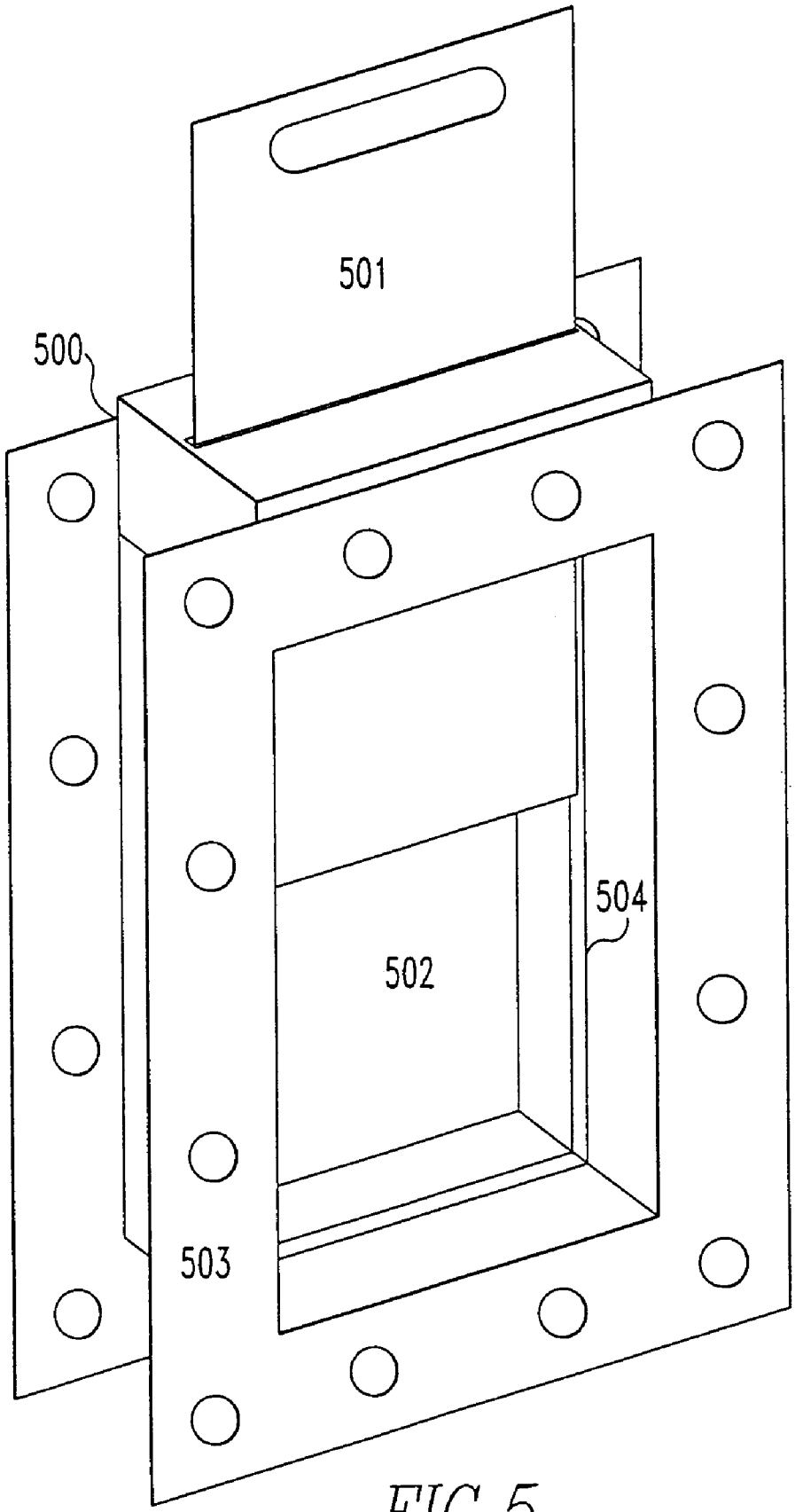
FIG. 5. Schematic representation of an explosion proof gate valve.

When there is no potential for explosion both kick-out door mechanisms 8 and 9 are attached directly to the pulverizer as shown in FIG. 7. When there is a danger of explosion or of fire, the kick-out door mechanism is attached to the pulverizer through an explosion proof gate valve 500 shown in FIG. 5. The gate valve is welded to the side wall of the grinding chamber. With the slide 501 pulled out, the inside of the pulverizer is reached through the opening 502 in the center of the gate valve frame 503. The slide 501 slides in the trough 504. The explosion proof gate valve is designed to withstand pressures of 50 psi.

A second mechanism 600 for removing particles from the inside of the pulverizer is shown in side view in FIG. 6. The mechanism is mounted to the side of the pulverizer 601 through explosion proof gate valve 500. The sampling device consists of a rectangular chamber 604 which is mounted to a flange 602 for attachment to the gate valve on the side of the pulverizer. The flange makes an angle of approximately 60 degrees with respect to the vertical. The gate valve 500 can be attached directly to the side of the pulverizer or can be attached to access doors on the side of the pulverizer using a transition plate 603. The transition plate is a plate which is thick enough to withstand 50 psi excursions in the pressure and which is used to accommodate the difference in the bolt hole locations on the gate valve 500 and those on the pulverizer. The chamber 604 contains a sampling device 605 which is rectangular in cross section and which is open at end 606 and has an opening in one wall at the other end 607 as shown in the Figure. A rod 608 is attached to the inside face of the sampling chamber at 613. This rod passes through the vertical wall at the back of the sampling mechanism at 609. A dustless connector 610 consisting of a cylindrical hollow fibrous plug surrounding the rod 608 and fitting inside a cylindrical sleeve 614 prevents dust leakage from the inside of the pulverizer. The rod 608 is used to move the sampling device 605 into and out of the pulverizer. The sampling device can be arranged to open up, as shown in FIG. 6, or to open down. Flange 611 connects the sampling device 600 to an air lock mechanism 612 for isolating the material being taken from the mill.

Particles removed from the pulverizer by separation devices 7, 8, 9, or 10 can be issued to reject stream 17 directly or conveyed 11 to feed hopper 20. The particles withdrawn from the internal circulation in the mill by any of the sampling mechanisms, 7, 8, 9, or 10 can be directed individually or in combinations to the reject stream 17. The conveyance mechanism 11 can be a screw conveyor or a conventional conveyor of the type manufactured by AFC of Clifton, N.J. The conveyance mechanism 11 and the separation mechanism 2 and return conveyance mechanism 16 and the reject conveyance mechanism 17 should be enclosed to prevent dusting. The capacity of the conveyors 11 ranges from 1/10 to the full rate at which particles are fed to the pulverizer and preferentially is in the range of 1/3 to 1/2 of the full rate of the feed. The capacity of the return conveyance devices 16 and the reject conveyance mechanism 17 ranges from 1/6 to the full rate of the feed to the pulverizer.

Particles are issued from feed hopper 20 to classifying screen 12. Oversize particles 15 generally coarser than 3 mm or 8 mesh taken from classifying screen 12 are conveyed to switch 19. The switch can divert the oversize particles back to the pulverizer through stream 16 or can discharge them to reject through stream 17, depending upon quality of the particles. The underflow at classifying screen 12 is conveyed to vibrating feeder 100 and thence to the electric and magnetic separator 13.

Figure 8:
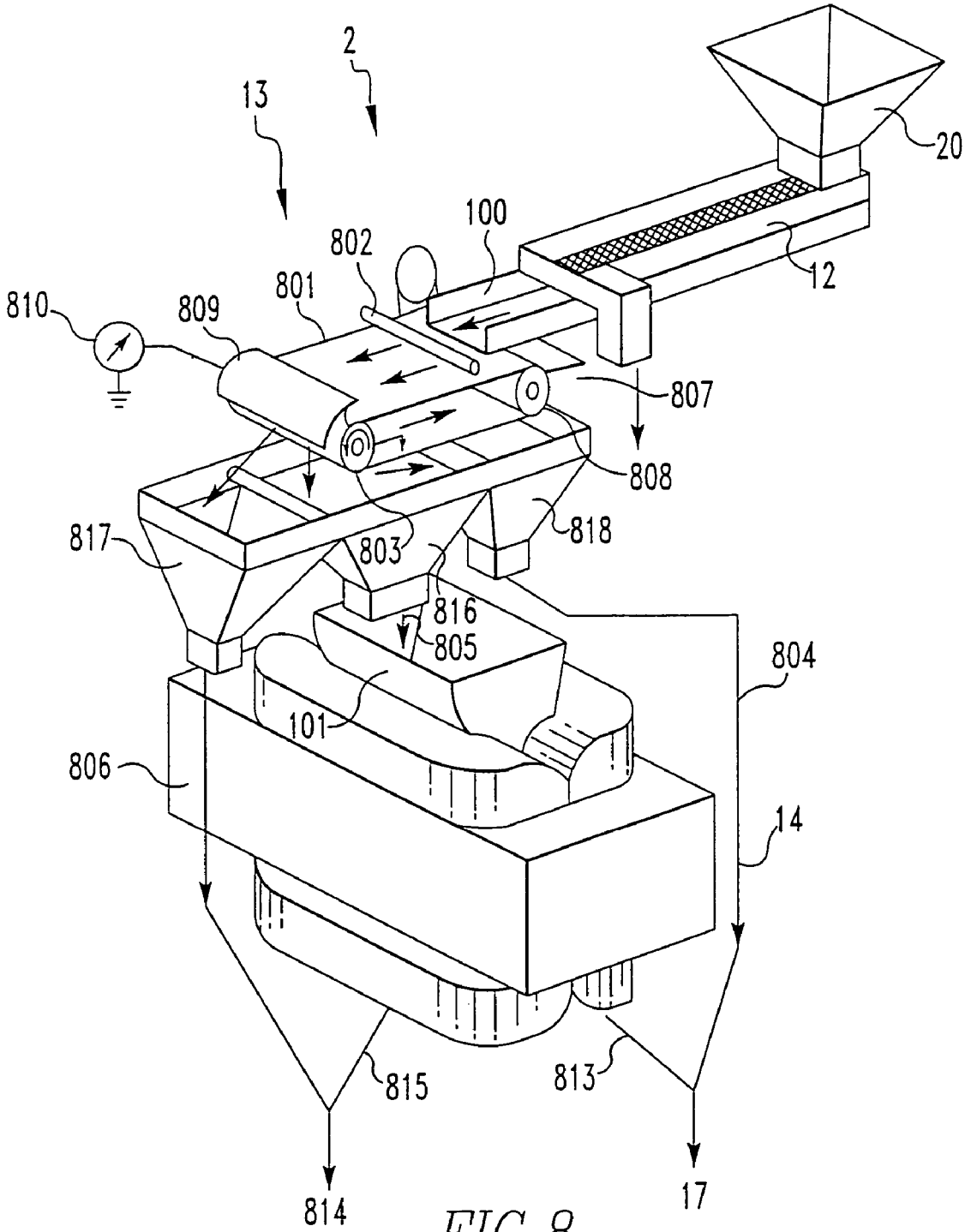
FIG. 8. Perspective view of an electric and magnetic separator.

The following description refers to FIG. 8. Particles in the size range from 0.07 mm to 3 mm discharge onto a vibratory feeder 100 of the type which can be obtained from Eriez Magnetics, Erie, Pa., such as Model No. 15A. The surface of the vibratory feeder 100 is made of a conducting material which has a work function which is intermediate between those of the particles to be separated. For example, in sorting coal particles containing mineral impurities copper may be used. The vibrating tray serves as a means to triboelectrically charge the particles and to move them to the surface of a belt conveyor 801. Particles with the lowest work function will generally become positively charged and the particles with greatest work functions will become negatively charged. The particles pass under a permanent magnet 802 as they fall onto the belt. The permanent magnet serves to remove strongly magnetic gangue material such as shards of iron which may be in the mixture of particles. The particles are further charged by sliding friction as they fall onto moving belt 801. The belt carries the particles to the magnetic pulley 803 at the end of the belt conveyor. The belt can be made from insulating, or conduction material and can have iron fibers implanted in the surface to enhance the magnetic field gradient at the surface of the magnetic separator 803. Preferably the belt is made from antistatic material such as can be purchased from Taconic, Petersburgh, N.Y.

Figure 9:
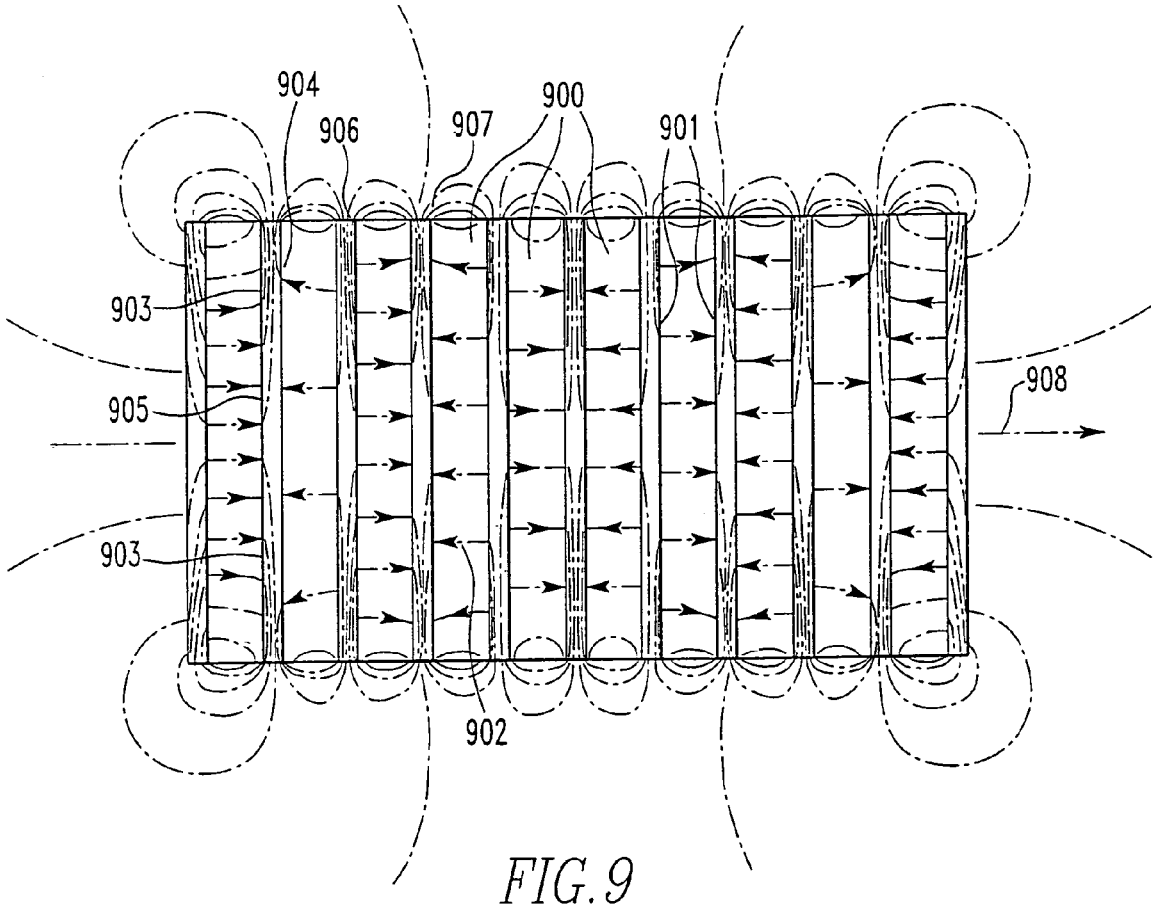
FIG. 9. View of magnetic flux lines in first stage permanent magnetic separator.

A vertical section through the center of magnetic pulley 803 is shown in FIG. 9. The permanent magnet separator is composed of a cylindrical arrangement of permanently magnetized elements 900 made from materials such as Samarium Cobalt or Neodymium-Iron-Cobalt which are separated by magnetic steel spacers 901. The permanent magnets are magnetized along their cylindrical axes and are arranged so that the magnetization 902 of each opposes that of the other all along the axis of the cylinder. In this fashion, the magnetic flux emerging over the faces of adjacent magnets is oppositely directed. The opposing fluxes 903 at faces 904 and 905 are conveyed outward along the radius of the cylinder through the steel spacers and emerge transverse to the surface of the steel spacers at 906 thus producing regions of highly divergent magnetic fields reaching outward from the surface of the permanent magnet which serve as capture sites for magnetic particles. The magnetic flux is returned to the magnet at regions 907.

Particles which migrate to the regions of high magnetic flux such as 906 and 907 and which are held there by magnetic forces at the surface of the belt are carried around the axis 908 of the pulley 803 by the belt 801 and drop free from underneath the belt at 804 as the belt pulls away from the cylindrical magnet surface. A doctor blade 807 is located at the back edge of the idler pulley 808 to remove particles adhering to the belt.

An electrode 809 is placed adjacent to the belt magnetic separator 13 as shown in FIG. 8. It can be adjusted to be a few millimeters from the surface of the particles on the belt and as much as a few centimeters. It is located so that particles deflected outward from the separator by electric and inertial forces can pass underneath the electrode and reach the receivers 816 and 817. The electrode is energized by voltage source 810. The voltage applied to the electrode generates an electric field at the surface of the permanent magnet 803 which permanent magnet is made part of the electrical circuit. The electric field can range from a few hundred volts per centimeter up to the breakdown strength of air. It is preferentially in the range of 1000 to 5000 volts per centimeter.

A catch basin 101 is located underneath the belt separator 13 to collect particles as they are thrown from the belt separator. The catch basin can be made from conducting or insulating materials. Non-conducting materials are preferred since there is less interaction with the applied electric field.

Particles collected in the receivers which are farthest from the magnet 803 are the least magnetic and have electric charge similar to that of the surface of the magnet. These particles are expelled to the weakly magnetic product through the chute 806. Particles which are charged oppositely to the surface of the magnet and which are the most magnetic will be collected at 818. They are expelled through chute 804. Particles with intermediate magnetism and with weak or no surface charging will be collected at 816. They constitute a middling fraction which is processed in the second magnet mechanism 14 for additional magnetic separation. These particles are expelled through chute 805 into magnetic separator 14.

Figure 10B:
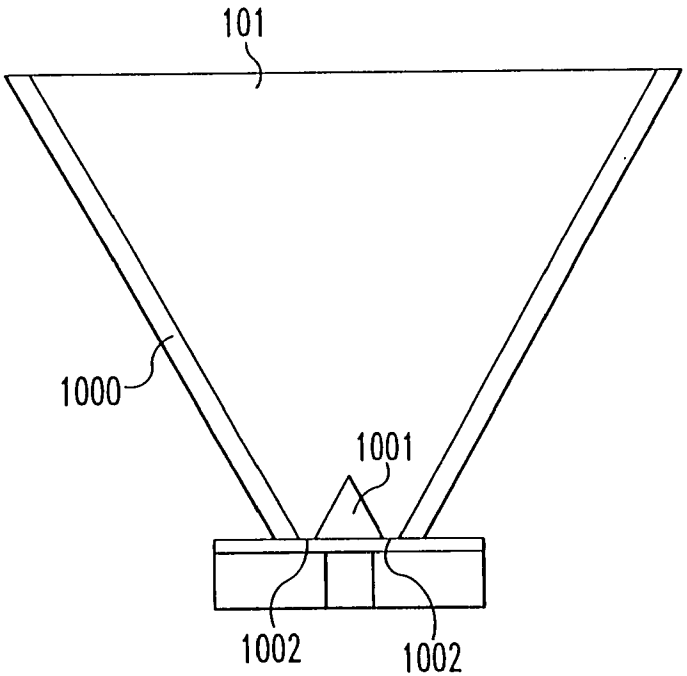
FIG. 10. End view of receiving bin 1010 and perspective view of manifold plate 1100.
Figure 10A:
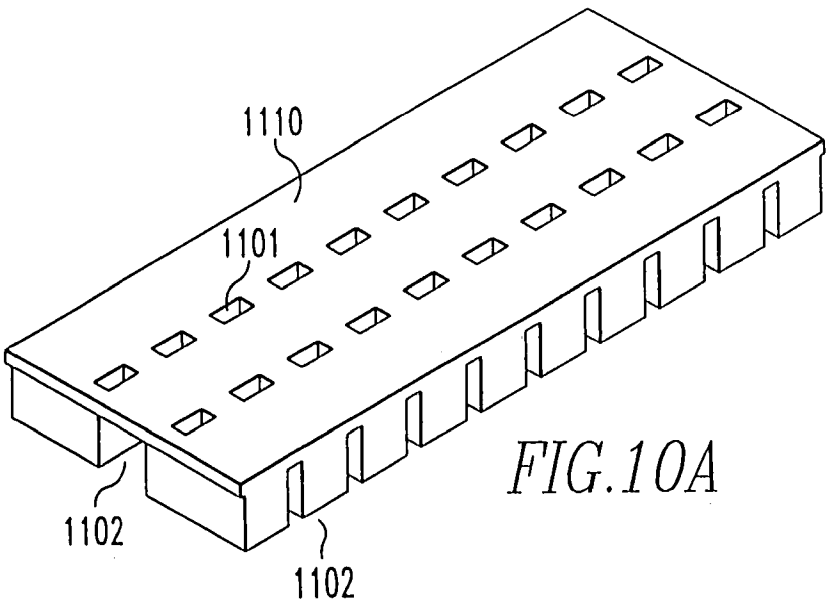
Figure 11:
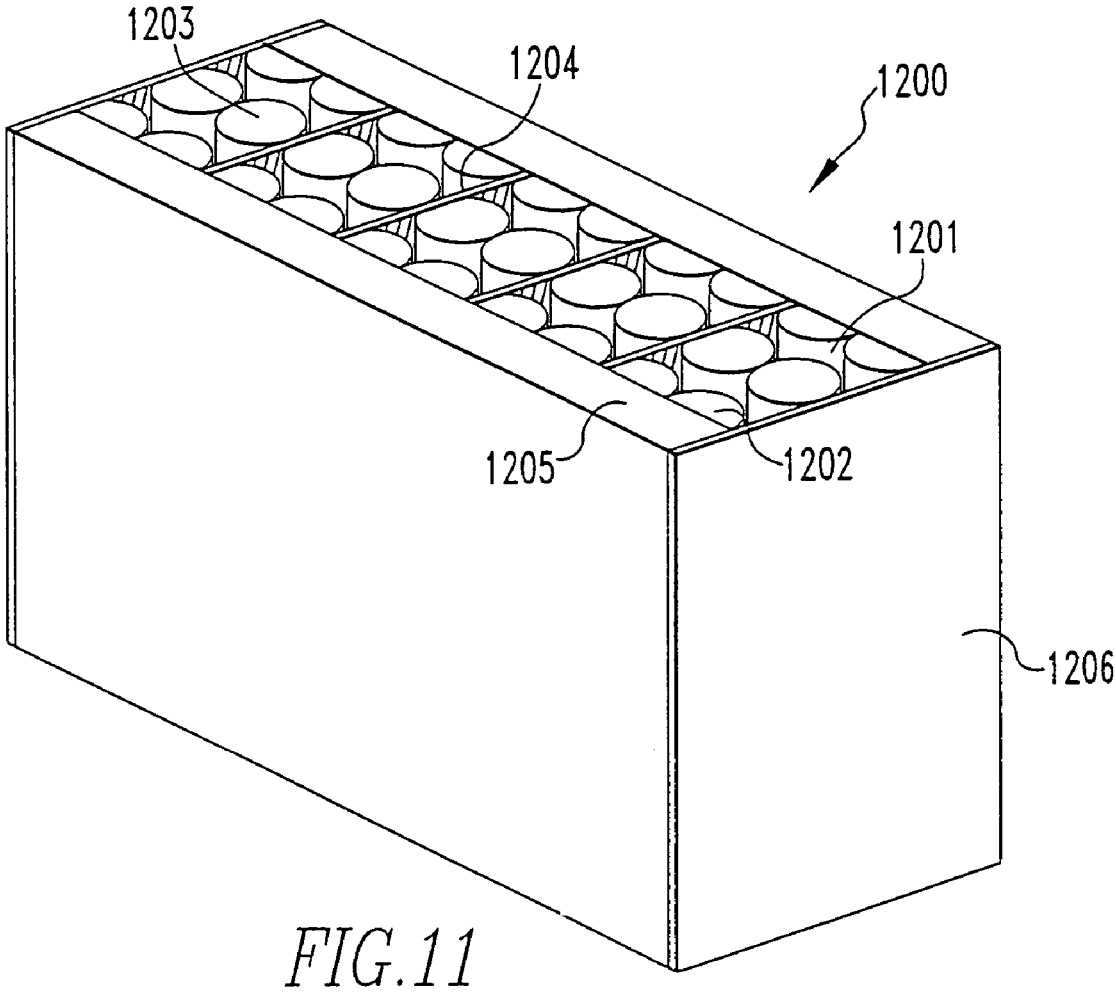
FIG. 11. Perspective view of magnetic matrix.

Particles exiting the first electric and magnetic separator at 805 fall into a receiving bin 101 shown in end view in FIG. 10. Particles are fed from bin 101 into the second magnetic separator 14. The bin can be made from a conducting or a non-conducting material. It is preferentially made from non-conducting material so as not to interfere with the electric fields produced by the first stage electric and magnetic separator. Bin 101 has sloped sides 1000 and has a divider 1001 running along its length to partition the bottom into two regions of equal area. Each of the two regions 1002 opens into a series of rectangular openings 1101 in the manifold plate 1100, which forms the bottom of bin 101. The manifold plate is aligned with and attached to the magnetic matrix 1200, shown in perspective in FIG. 11, located inside the working volume of the transverse access electromagnet 1300 shown in FIG. 12. The manifold plate 1100 has openings 1101 in its upper surface which communicate with openings 1201 between the poles 1202 of the magnetic matrix. Poles 1202 are half-cylinders. The manifold plate 1100 has openings 1102 at either end under the divider and along each side between the openings 1101 for the purpose of admitting air into the magnetic separator along with the particles. The particle flow drags air so that the air and coal are balanced as the particles enter the region 1201 between poles 1202. Without the openings 1102, the coal could draw air into the separation chamber in a non-balanced manner and disrupt the flow through the separator.

The magnetic matrix 1200 is magnetized by the surrounding transverse access electromagnet 1300 and is an integral part of the magnet circuit. (The electromagnet 1300 is shown in top view in FIG. 13 with the magnetic matrix removed.) It is shown in top plan view in FIG. 14 with the magnetic matrix installed. The design for the electromagnet of this invention is an iron encased split solenoid with transverse access. Both the coil 1301 and the iron 1302 surround the working volume so both contribute to the field there. As is apparent in FIG. 14, both the electromagnet coil and the magnetized iron contribute to the magnetic field which magnetizes the separation matrix.

Figure 12:
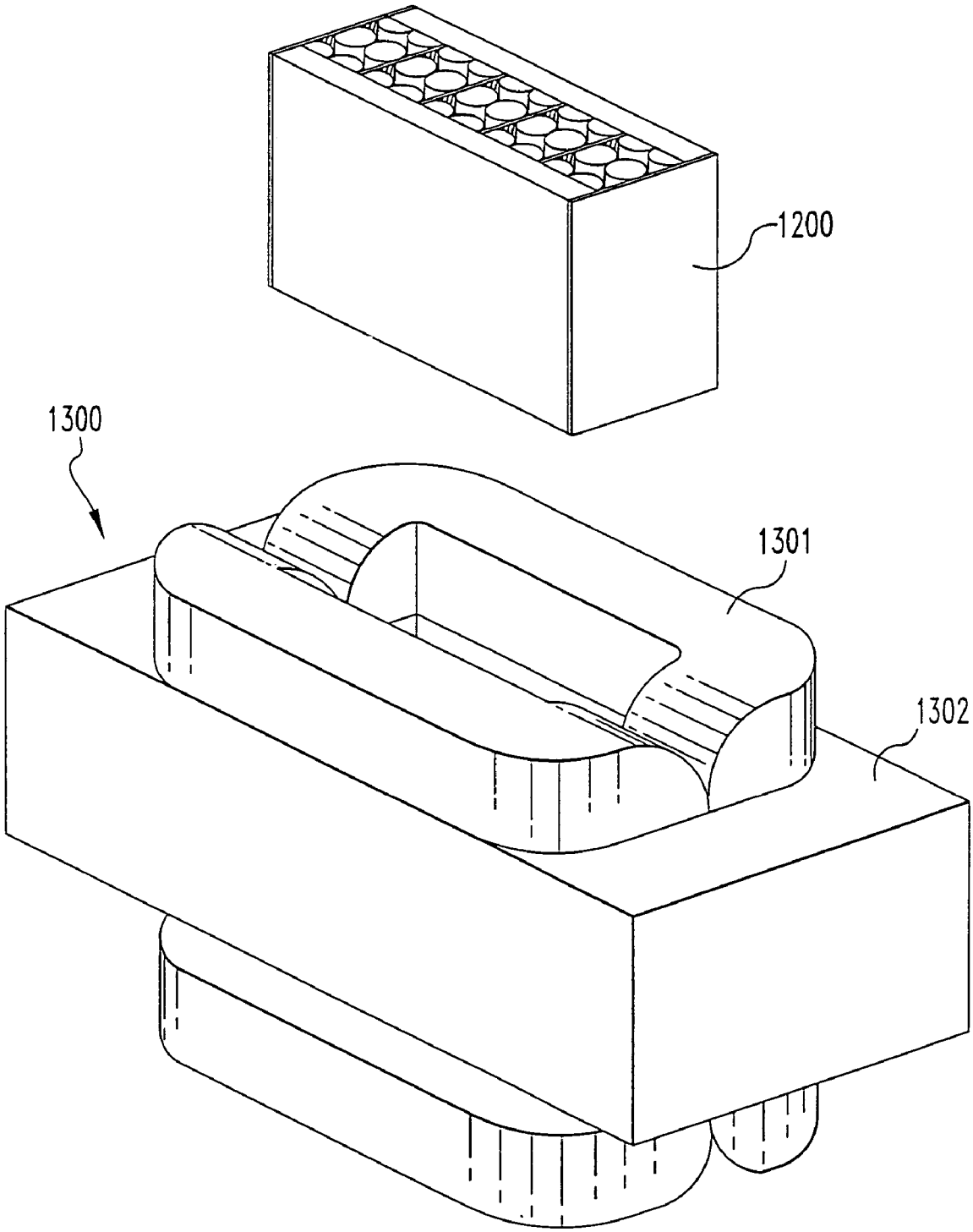
FIG. 12. Perspective view of electromagnet 1300 and magnetic matrix 1200.

The transverse access electromagnet shown in FIG. 12 has two saddle-shaped coils 1301. They are inserted in the working volume of the magnet frame and each is folded outward at the top and the bottom of the magnet to permit transverse access. This opens the working volume inside the electromagnet between the coils. The separation matrix 1200 shown removed from the magnet in FIG. 12 is placed in the working volume between the coils 1301 when in operation.

Figure 13B:
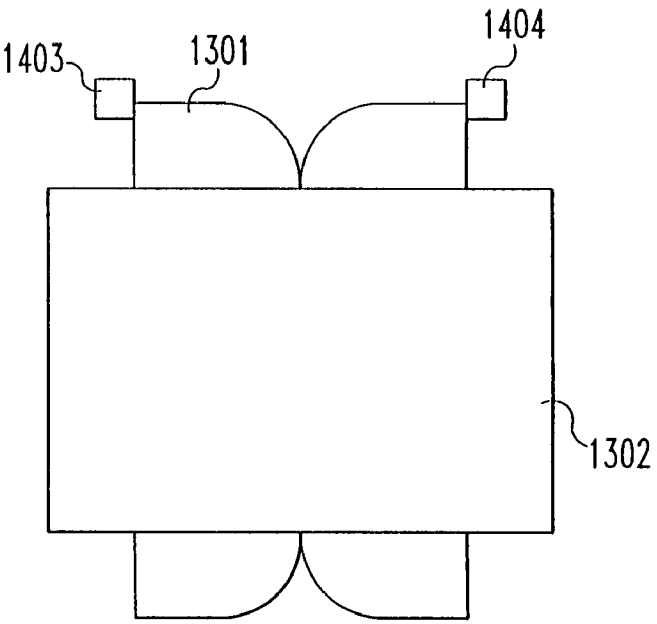
FIG. 13. Top view of electromagnetic separator with magnetic matrix in place.
Figure 13A:
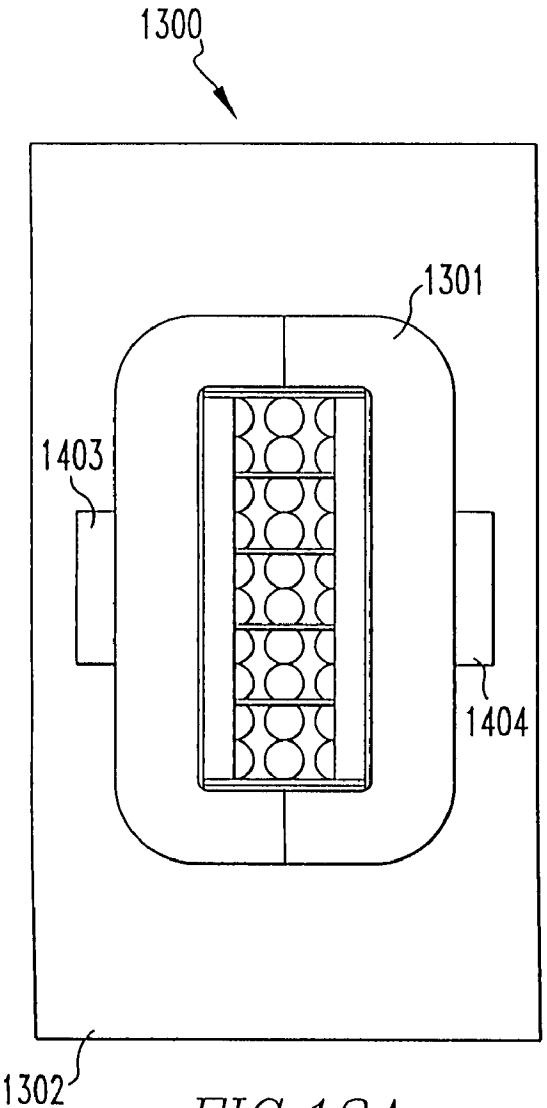
Figure 14:
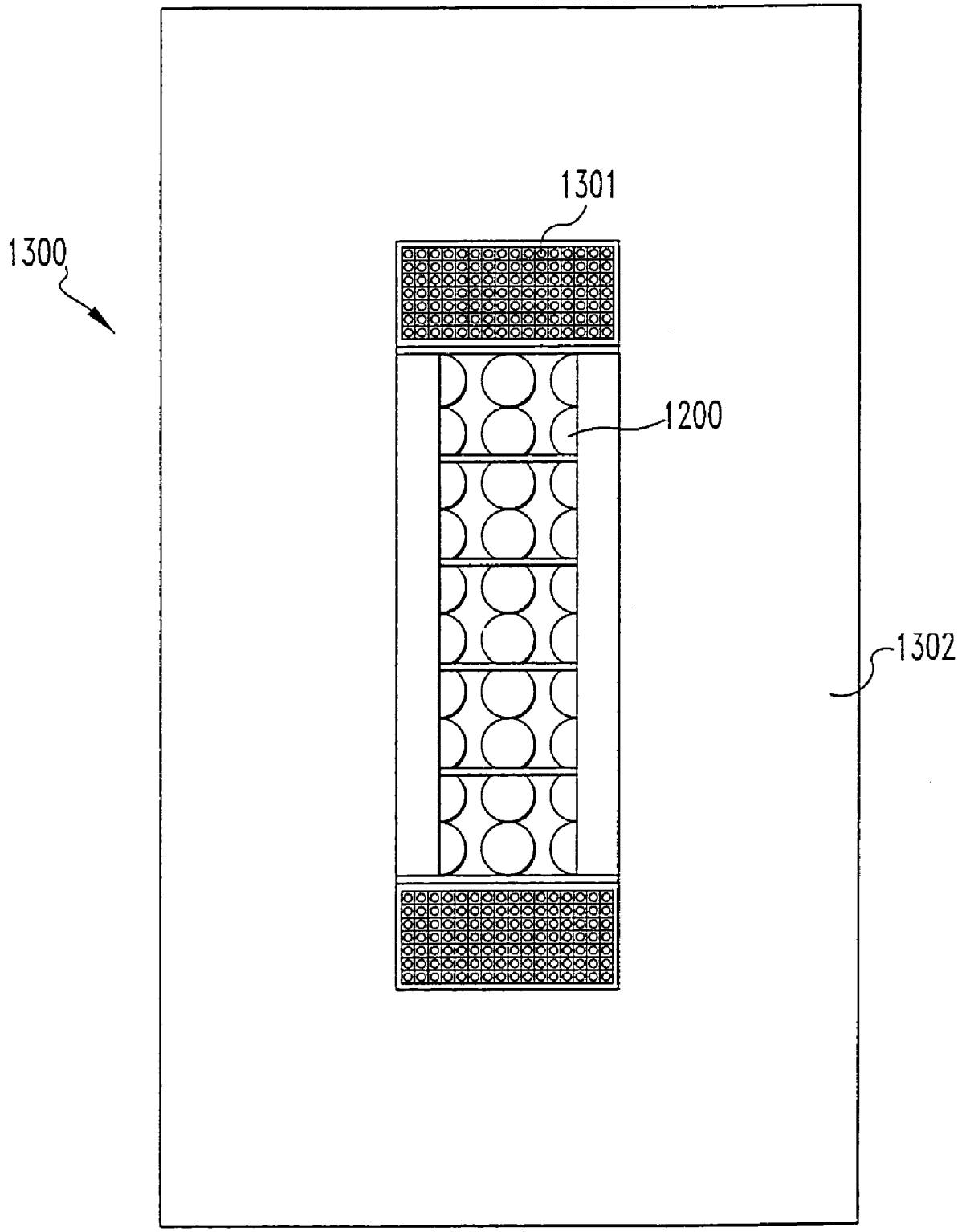
FIG. 14. Top view of electromagnet showing iron frame, matrix and coils.

A plan view of the top of the electromagnet 1300 with the magnetic matrix 1200 removed is shown in FIG. 13. The iron yoke 1302 is a rectangle with rectangular shaped hollow center. The iron frame can be cast or can be made from separate pieces which are bolted together. The iron frame is preferably made from annealed cast iron, 1002, 1006, or 1008 carbon steel or better. The width of the walls and the height of the iron frame is made great enough to conduct the magnetic flux generated by the current in the energizing windings.

Looking from above in FIG. 13, the individual coil windings rise up and out of the plane of the figure at the top and return into the plane of the figure at the bottom. They are comprised of two saddle shaped coils 1301. Each is folded outward on the upper and lower magnet surfaces to allow access transverse to the direction of the magnetic field which is directed from left to right in the plane of the drawing. The electric current is directed out of the plane of the paper in the upper portion of each coil and is directed into the plane of the paper in the lower portion of the coils. The current coming up in the upper coils flows horizontally outward on the top of the magnet through the coils which have been folded over and returns through the windings in the lower portion of the figure. This produces a magnetic field directed to the right in the horizontal plane of FIG. 13.

One end of the windings 1403 is shown in the left portion of the figure, the other 1404 in the right portion. Current connections are made at these ends to an external power supply (not shown) such as that supplied by Electronic Measurements, Inc., Neptune, N.J. The coil windings are made from copper or other suitable conductor and can be hollow to accommodate cooling. Connections are also made at these endings for cooling water supplied by a chiller (not shown) such as that supplied by Affinity Inc., Ossipee, N.H.

Figure 15:
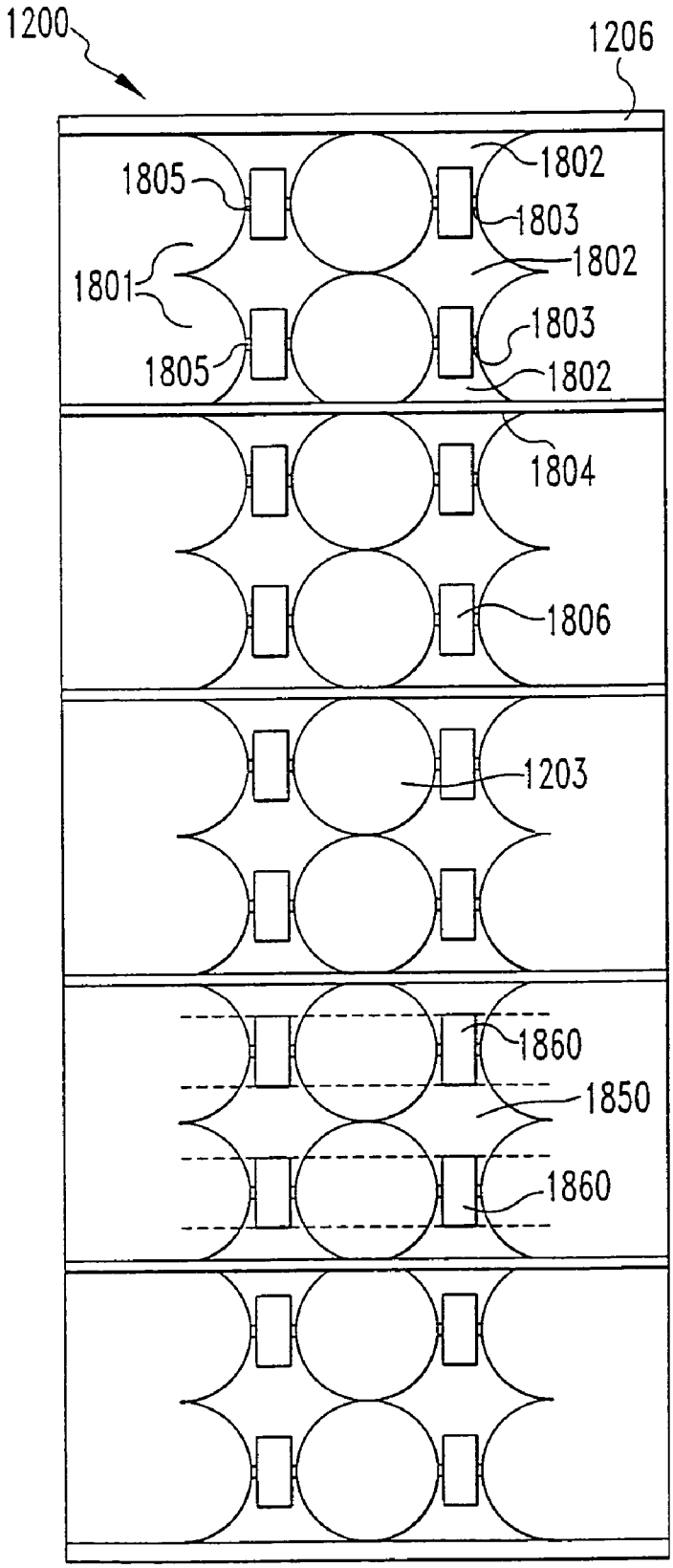
FIG. 15. Plan view of magnetic matrix showing drop areas for particles.

Referring now to FIG. 15, there is shown a plan view of a magnetic matrix 1200 which consists of two columns of poles which columns are divided into groups of four pole pairs each. Particles are introduced at the top of the matrix into the rectangular regions 1806 between poles and fall along the length of the poles to an exit at the bottom. The pole length is chosen to give sufficient residence time for separation which occurs in the plane of the figure. For processing coal, the pole length can be from 4 inches to 12 inches and is preferentially 9 inches. The residence time for particles falling through the matrix is a fraction of a second.

The weakly paramagnetic or diamagnetic particles in the stream of particles entering at 1806 are pushed by magnetic forces outward into the regions 1802 where the magnetic field strength is lowest. Paramagnetic particles are attracted and trapped in the regions 1803 near the pole tips. The magnetic force is sufficient to separate the particles but not strong enough for particles exiting the first electric and magnetic separator at 805 to stick to the poles in the magnetic separator 14. The particles which pass generally have magnetic susceptibilities less than about $5*10^{-9}$ $m^3/kg$.

Shown in FIG. 15 are magnetic rods 1805 which are affixed to the faces of the poles 1801. The rods serve to increase the local magnetic field in the region immediately adjacent the pole tips. This has the effect of reducing the volume between poles in which the magnetic force is small. Preferentially, the diameter of the steel rod is 1% to 10% of the diameter of the matrix pole and more preferentially 4%.

In the bottom portion of FIG. 15 is shown a top view of knife edge splitters 1901 located underneath the bottom of the matrix 1200. These splitters divide the stream of particles exiting the magnetic separator into separate streams based on the magnetism of the particles. The splitters can be adjusted as shown in FIG. 16 so as to vary the area open between each.

Figure 16:
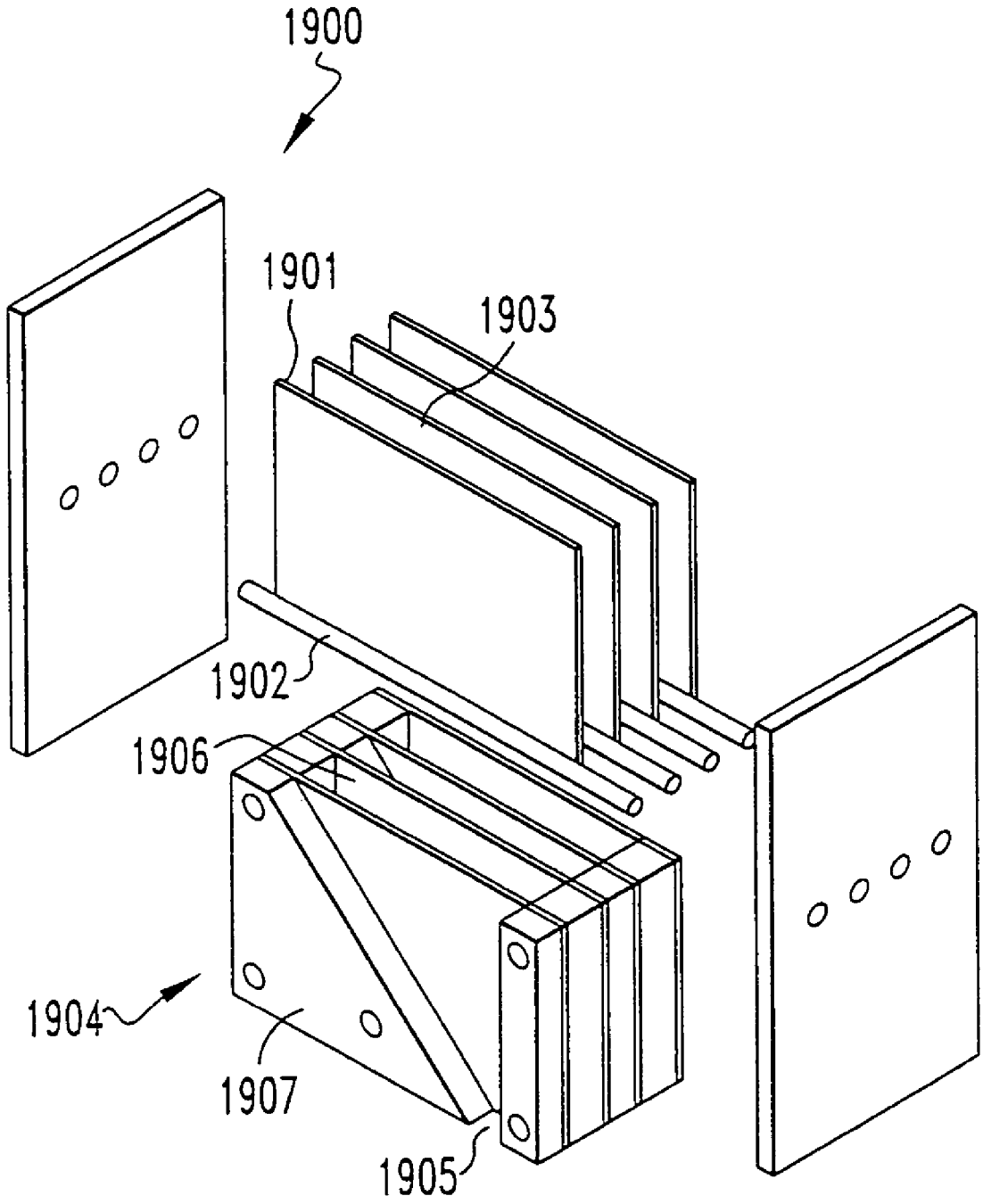
FIG. 16. Perspective view of splitter mechanism.

Referring now to FIG. 16, a splitter mechanism 1900 of the type described in U.S. Pat. No. 5,017,283 (May 21, 1991), incorporated by reference herein, is shown in exploded view. The mechanism 1900 is assembled using end plates 1906 and is aligned with the exit of the splitter and supported independently. Each splitter 1901 is hinged at the bottom so that it can be rotated from the vertical. In this way, the top opening between vanes can be adjusted individually or collectively. The bottom opening between hinges 1902 is fixed and is approximately ¼ of the width of each pole pair which is twice the diameter of the poles 1801.

The particles collected in adjacent openings 1903 between splitters have different magnetic susceptibilities. Referring now to FIG. 15 each opening for collection of diamagnetic particles 1850 will be sandwiched between two openings for collection of paramagnetic particles 1860, except at the opposite ends of the magnetic matrix, each of which will collect diamagnetic particles.

Particles exiting at the bottom of splitter 1901 fall directly into chute mechanism 1904. Each segment 1906 of this mechanism has a ramp 1907 which directs the falling particles laterally out of the separator through holes 1905. The ramp in each adjacent segment is sloped oppositely so that all particles of like magnetism exit the separator on the same side. Paramagnetic particles will be on one side and diamagnetic particles will be on the other.

The composite stream of diamagnetic particles is discharged through chute 815 of FIG. 8. It is combined with diamagnetic or weakly paramagnetic particles separated from the first electric and magnetic separator and expelled through stream 806. The composite stream of diamagnetic or weakly paramagnetic particles is expelled through chute 814 to stream 16. The composite stream of paramagnetic particles exiting magnetic separator 14 exits the separator in stream 813. It can be combined with the stream of strongly paramagnetic particles exiting the first electric and magnetic separator 804 to make stream 17. The width of the collection chambers can be adjusted through hinged baffles 1905–1902 which can be rotated to change relative recoveries of paramagnetic and diamagnetic particles. Increasing the width of the collection chamber for diamagnetic particles and decreasing that for paramagnetic particles will increase the diamagnetic particle weight recovery and decrease the quality of the diamagnetic particle product and vice versa. It is apparent that the system of splitters can be used to separate particles of any type of magnetism. It is not restricted to paramagnetic and diamagnetic particles only.

The weakly magnetic particles exiting the first electric and magnetic separator at 806, the diamagnetic particles exiting the second magnetic separator at 815, the paramagnetic particles exiting the second magnetic separator at 813, and the strongly magnetic particles exiting the first electric and magnetic separator at 804 can each be collected separately or can be combined as desired.

FIG. 1 and the description which follows it illustrates a preferred embodiment of this invention. The air-swept pulverizer used for illustration is of the ring/roller type such as that manufactured by Bradley Pulverizer Company of Allentown, Pa. While the grinding mechanism employed is that of a ring/roller mill, all other mills for which particles circulating inside the mill can be accessed, such as hammer mills and roller mills, can be used. The classifier oversize material which is returned to the grinding zone from pulverizers such as ball mills can also be treated by the method of this invention. The method described above can be used in pulverizers employing under pressure or over pressure. Further the preferred separator means including size classification and magnetic separation are illustrative of the invention and are not intended to be limiting. Other mean of separation can be employed such as size classification alone, or magnetic and electric separation, cyclones, air tables, etc.

Figure 18:
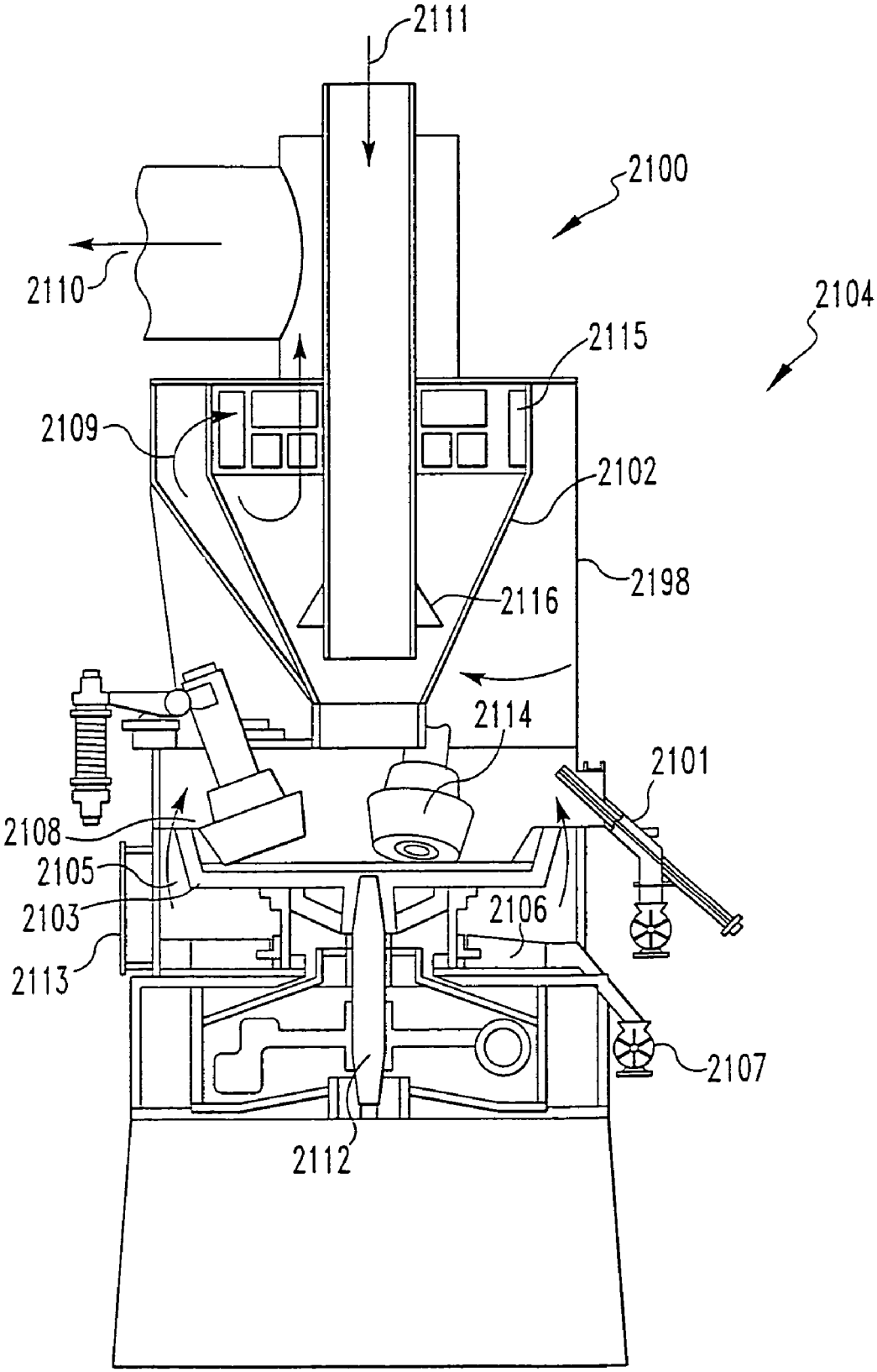
FIG. 18. Cutaway view of a bowl mill.

Referring now to FIG. 18, there is shown a cut-away view of a bowl mill 2100 such as a Model 633 made by CE Raymond. This is an air-swept pulverizer. Particles are fed down the center pipe 2111 onto a bowl shaped grinding table 2103. This bowl is rotated from below by drive shaft 2112. Air is blown into the base of the mill through inlet 2113 and swirls upward into the grinding chamber 2108 through a narrow throat opening between the outside of the bowl 2103 and the inside wall of the mill. Because of the narrow opening at the throat the air velocities are thousands of feet per minute, typically 7000 feet per minute. Particles landing on the surface of the bowl are slung outward by rotation and are ground as the table rotates underneath the grinding rolls 2114. Particles are splashed and swept in all directions inside the mill as they are released in the grinding action on the bowl. Heavy particles fall back to the table and are ground further. Particles are swept upward by the swirl of air 2109. Some particles are thrown outward hitting the inside wall of the mill as they travel upward. These particles fall back to the bowl for additional grinding. Other particles are conveyed to the top of the mill and enter the classifier 2102 through the vanes 2115. The finest of the particles are discharged from the mill through the pipe 2110. Oversize particles fall to the bottom of the inverted cone of the classifier 2102 and are mixed with the feed particles at 2116 and thence discharged to the bowl 2103.

This pulverizer is different from the ring/roller in that a rotating bowl and stationary roller are employed as opposed to rotating rollers and a stationary ring. Further, this mill has a mechanism 2107 for discharging large pieces of very hard particles such as machine parts and railway spikes from the grinding zone in order to protect the mill. In grinding coal this is called a pyrite trap. Particles which are small enough to pass through the vane openings in the throat and which are heavy enough to fall under the air drag in that region will discharge underneath the bow and be swept by scrapers 2106 to the discharge chute 2107. When grinding coal, the rate at which particles emerge through the pyrite trap is very small, about 0.1% of the rate at which particles are fed to the pulverizer. This discharge mechanism is designed to protect the mill and not to improve the quality of the mill product.

Contrary to the pyrite traps, the MagMill™ is designed to remove large amounts of the particles circulating inside the mill. These particles are removed and processed external to the mill so as to improve the quality of the mill product. Withdrawal rates between 10% and 100% of the rate of feed to the mill and preferably 30% to 50% are employed.

A mechanism for removing mill concentrated material from the internal circulation of the mill is shown at 2101. This mechanism is of the types shown in FIGS. 3, 6, and 7. FIG. 3 shows a screw conveyor. This can be used to separate particles from the surface of the bowl or from the return from the classifier at 2116. Particles have been withdrawn from pulverizers at the rate of 1 ton per hour through 3-inch opening screw conveyors of the type manufactured by AFC of Clifton, N.J. Multiple screw conveyors can withdraw significant amount of particles from pulverizers.

FIGS. 6 and 7 illustrate two mechanisms for removing particles moving near the walls of the mill. The mechanism of FIG. 6 can open at the wall of the mill or can extend several inches inside. The mechanism of FIG. 6 has removed particles from CE Raymond 633 and 823 mills at rates ranging from 1 TPH per Square Foot of opening up to 7.3 TPH per Square Foot of opening. The opening in square feet required to achieve the preferred withdrawal rate of 30% of the feed is about 0.05 times the rate at which the mill is fed. For a 50 TPH pulverizer, an opening in the mill wall of 1.5 feet on a side will handle this amount of material. In order not to disrupt the flow inside the mill, several smaller withdrawal mechanisms would be employed located around the circumference of the mill.

Particles withdrawn from the pulverizer by mechanisms 2101 can be either issued to reject stream 17 directly or conveyed 11 to separation mechanism 2 as shown in FIG. 1. The separation mechanism used here is exactly the same as that discussed above for the case of the ring/roller mill. The particles to be returned to the pulverizer from separation mechanism 2 can be returned through the wall of the pulverizer at 2198 or preferably through the feed chute 2111. An air lock mechanism 612 of FIG. 6 or 705 of FIG. 7 is employed to isolate the atmosphere inside the mill from that in the separation mechanism 2. Reject particles are discharged from the pulverizer and separation mechanism into stream 17 of FIG. 1.

Figure 19:
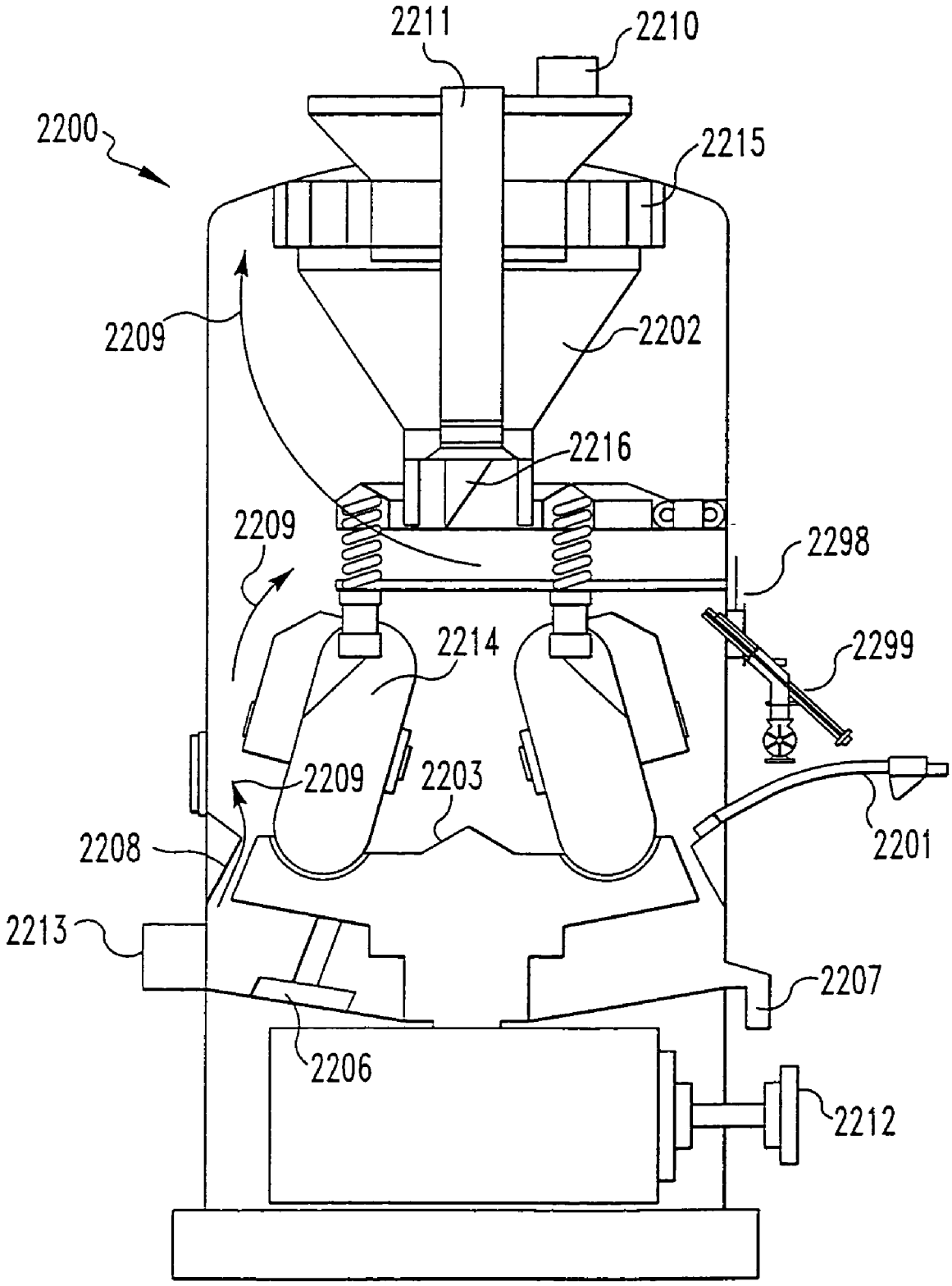
FIG. 19. Cutaway view of a roller mill.

Referring now to FIG. 19, there is shown a cut-away view of a roller mill 2200 such as a Model MPS-89 made by Babcock & Wilcox. This is an air-swept pulverizer. Particles are fed down the center pipe 2211 onto a grinding table 2203. The table is rotated from below by drive mechanism 2212. Air is blown into the base of the mill through inlet 2213 and swirls upward into the grinding chamber through a narrow throat opening 2208 between the outside of the table 2203 and the inside wall of the mill. Because of the narrow opening at the throat the air velocities are thousands of feet per minute, typically 7000 feet per minute. Particles landing on the surface of the table are slung outward by rotation and are ground as the table rotates underneath the tires 2214. There is a groove on the table surface which guides the tires. Particles are splashed and swept in all directions inside the mill as they are released in the grinding action on the table. Heavy particles fall back to the table and are ground further. Particles are swept upward by the swirl of air 2209. Some particles are thrown outward hitting the inside wall of the mill as they travel upward. These particles fall back to the table for additional grinding. Other particles are conveyed to the top of the mill and enter the classifier 2202 through the vanes 2215. The finest of the particles are discharged from the mill through the pipes 2210. Oversize particles fall to the bottom of the inverted cone of the classifier 2202 and are discharged through flap valves 2216 to the table 2203.

This pulverizer is different from the ring/roller in that a rotating table and stationary tires are employed as opposed to rotating rollers and a stationary ring. Further, this mill has a mechanism 2207 called a pyrite trap for discharging large pieces of very hard particles such as machine parts and railway spikes from the grinding zone in order to protect the mill. Particles which are small enough to pass through the vane openings in the throat and which are heavy enough to fall under the air drag in that region will discharge underneath the table and be swept by plows 2206 to the discharge chute 2207. When grinding coal, the rate at which particles emerge through the pyrite trap is very small, about 0.1% of the rate at which particles are fed to the pulverizer. This discharge mechanism is designed to protect the mill and not to improve the quality of the mill product.

Contrary to the pyrite traps, the MagMill™ is designed to remove large amounts of the particles circulating inside the mill. These particles are removed and processed external to the mill so as to improve the quality of the mill product. Withdrawal rates between 10% and 100% of the rate of feed to the mill and preferably 30% to 50% are employed.

A mechanism for removing mill concentrated material from the internal circulation of the mill is shown at 2201. This mechanism is of the type shown in FIG. 3. FIG. 3 shows a screw conveyor. This can be used to separate particles from the edge or the surface of the table, from the groove in which the tires roll, or from the return from the classifier at 2216. Particles have been withdrawn from pulverizers at the rate of 1 ton per hour through 3 inch opening screw conveyors of the type manufactured by AFC of Clifton, N.J. Multiple screw conveyors can withdraw significant amount of particles from pulverizers.

Yet another mechanism 2299 for removing particles from the pulverizer is shown in the Figure. This mechanism is of the types shown in FIGS. 6 and 7 and is used for removing particles moving near the walls of the mill. The mechanism of FIG. 6 can open at the wall of the mill or can extend several inches inside. The mechanism of FIG. 6 has removed particles from MPS-89 mills at rates ranging upward to 7.3 TPH per Square Foot of opening. The opening in square feet required to achieve the preferred withdrawal rate of 30% of the feed is about 0.05 times the rate at which the mill is fed. For a 50 TPH pulverizer, an opening in the mill wall of 1.5 feet on a side will handle this amount of material. In order not to disrupt the flow inside the mill, several smaller withdrawal mechanisms would be employed located around the circumference of the mill.

Particles withdrawn from the pulverizer by mechanisms 2201 and 2299 can be conveyed directly to reject stream 17 or conveyed 11 to separation mechanism 2 as shown in FIG. 1. The separation mechanism used here is exactly the same as that discussed above for the case of the ring/roller mill. The particles to be returned to the pulverizer from separation mechanism 2 can be returned through the wall of the pulverizer at 2298 or preferably through the feed chute 2211. An air lock mechanism 612 of FIG. 6 or 705 of FIG. 7 is employed to isolate the atmosphere inside the mill from that in the separation mechanism 2. Reject particles are discharged from the pulverizer and separation mechanism into stream 17 of FIG. 1.

Figure 17:
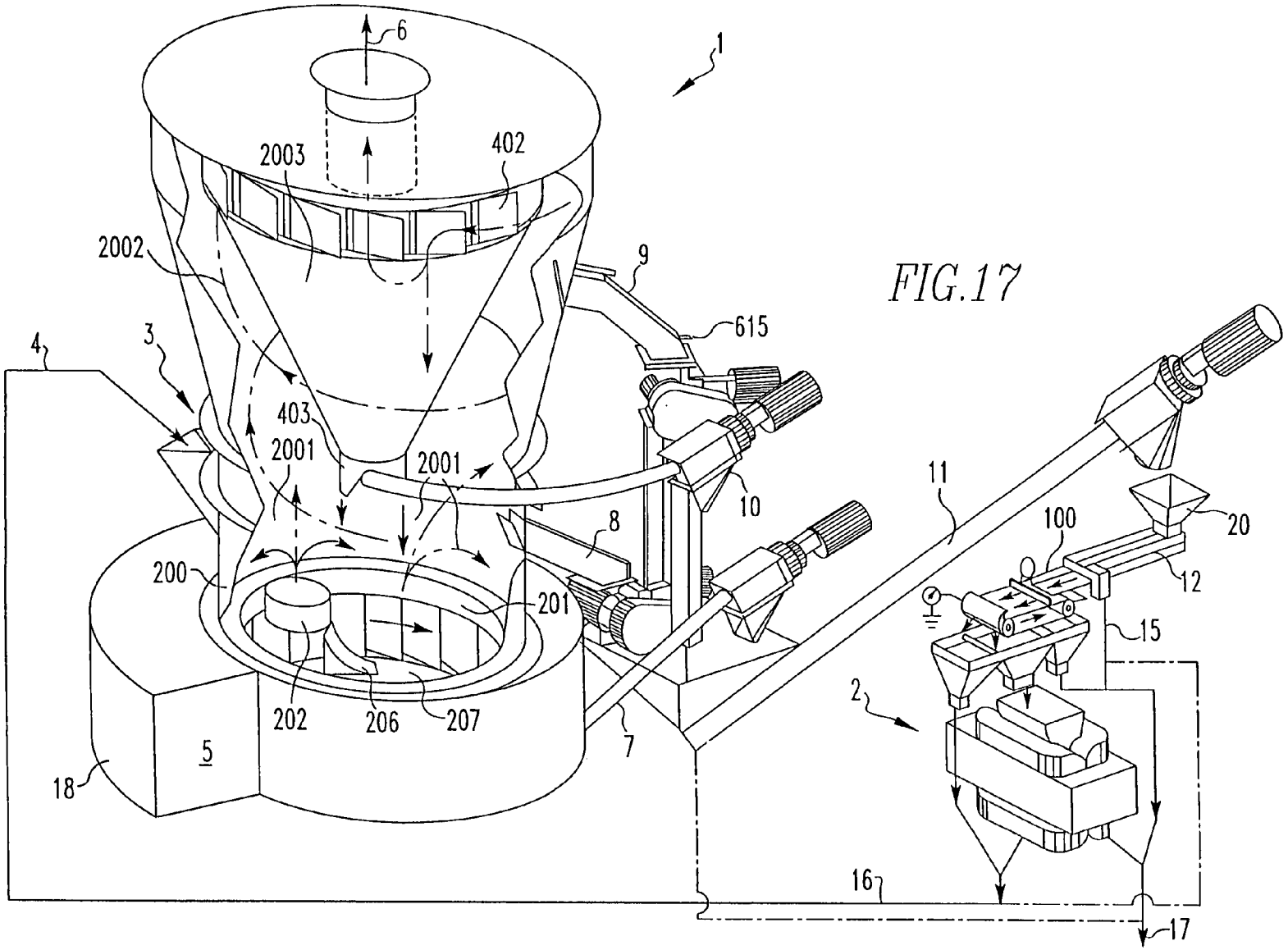
FIG. 17. Cutaway view of a MagMill™ employing a ring roller pulverizer.

The MagMill™ shown in cut-away view in FIG. 17 employs a comminution device 1 and associated dry magnetic separator means 2 for improving the quality of the output of the comminutor. In a MagMill™ pulverizer the particles which are reduced to product fineness, nominally 70 to 80% finer than 75 microns top size, will exit the mill as product 6 and are blown directly to the downstream processing. In a conventional pulverizer, all particles which enter the mill will eventually exit at 6. In a MagMill™ not all particles exit in stream 6. Particles exiting at the top of the pulverizer at 6 are the more friable particles in the feed. The hard particles are separated from the more friable particles and rejected from the mill in stream 17. Thus, unlike at conventional pulverizer, a MagMill™ makes two products. Particles inside the pulverizer which are coarser than the product specification are returned to the grinding zone as part of the mill internal circulation 2001. These are the less friable particles in the mill feed and are generally hard and abrasive. These particles concentrate in the oversize fraction of the internal circulation. For coal, these are ash-forming minerals, especially iron pyrites. These hard particles are further separated from the bulk of the particle flow inside the mill by weight, inertial forces, and air flow resistance. They are found primarily in regions of low elevation in the pulverizer. In the upper regions, these particles tend to be located near the inside walls of the pulverizer. The hard particles are both concentrated and first separated inside the pulverizer.

A portion of the hard particles are withdrawn from the mill by particle sampling mechanisms 7, 8, 9, and 10. Some types of conventional pulverizers such as roller mills separate large and very hard debris such as iron spikes from the grinding zone through openings in the air flow passages in the bottom of the pulverizer (not shown here). These openings are generally called pyrite traps. They remove a very small amount of material from the pulverizer, generally less than 0.1% of the feed. The pyrite traps are intended to protect the pulverizer from damage. They are not used to improve the quality of the product of pulverizing. In a MagMill™, material is removed from the inside of the pulverizer through sampling mechanisms 7, 8, 9, & 10 at a very high rate. This can be as much as 100% of the rate at which particles enter the mill. Preferably, it is between 10% and 100% of the feed rate. More preferably it is between 30% and 50% of the feed rate. The purpose of removing this material is to improve the quality of the product. The advantage of processing this stream of particles taken from the internal circulation of the pulverizer is the extra mineral liberation in this stream. The particles are intermediate in size between the size of particles fed to the pulverizer and that issued in the product. Separation-of particles in this stream is more efficient than treating the feed. Further, this stream of particles has a high concentration of the hard material to be removed so that the separation mechanism 2 can be smaller than that required to treat the entire stream. The MagMill™ is a technically and economically advantageous method for improving the quality of the pulverizer product.

Particles which are removed from the internal circulation of the pulverizer through sampling mechanisms 7, 8, 9, & 10 can be either issued to reject stream 17 directly or fed to the hopper 20 and screening device 12 where oversize particles 15 are withdrawn. The particles withdrawn from the internal circulation in the mill by any of the sampling mechanisms 7, 8, 9, or 10 can be directed individually or in combinations to the reject stream 17 when the quality of the particles does not warrant processing through separation mechanism 2. Oversize particles are those which are too coarse for effective treatment in the separation mechanism 2. They are generally coarser than 8 mesh or about 3 mm. The top-size is dependent on the characteristics of particles to be processed in the separation mechanism. Generally, strongly magnetic particles can be processed efficiently at a coarser size consist than can feebly magnetic particles such as coal. When grinding coal, pulverizer concentrated particles are generally smaller than 8 mesh with only a few percent finer than 100 mesh. If the oversize particles coarser than 8 mesh are highly concentrated in hard impurity particles, they are rejected to stream 17. Otherwise the oversize particles are returned to the pulverizer for additional grinding through steam 16. Under size particles, generally finer than 8 mesh, are fed to the electric and magnetic means 2 where particles are separated on the basis of air drag, particle mass, surface charging, and magnetic characteristics. The less desirable hard particles separated by separator 2 are rejected from the MagMill™ in stream 17. The friable particles recovered by the magnetic separator are returned to the pulverizer for grinding to specification in stream 16. For coal, separation of mineral gangue results in a pulverized-coal product which has lower concentrations of ash, sulfur, and associated trace metals than the coal fed to the pulverizer.

The following description of the method is given in terms of pulverizing coal in a ring/roller mill. It illustrates the principles of separation in operation inside the mill and shows the function of the electric and magnetic separator. While the grinding mechanism illustrated is that of a ring/roller mill, mills and crushers of other types could have been used and products coarser than pulverized are possible. Further, the separation mechanism shown is not limiting. Means for particle size classification other than screening such as air classifiers, air tables, air cyclone, etc. can be used. Additionally, in some instances only the first stage ElectriMag Separator may be required.

FIG. 17 is a cut-away view of a MagMill™ pulverizer which consists of an air-swept ring/roller pulverizer 1 and a separation means 2 working together. Raw feed 3 consisting of a plurality of particles of widely differing sizes with varying degrees of association enters the pulverizer 1 through the mill housing at 4. The largest particle is generally ½ inch to 1 inch in size. The feed can enter the mill from the top as well using means not shown. For coal pulverizing, the ash concentration of the feed coal may range from a few percent on a weight basis to 30 to 50 Wt. % or even higher while 7 to 10% is typical. The sulfur content may range from below 1 Wt. % up to 5 to 10 Wt. % or even higher while 1 to 2% is typical. The MagMill™ 1 separates a mineral fraction, iron pyrite, which generally contains 50% of the sulfur in the coal. The concentration of the iron pyrite in the feed to the MagMill™ can range from less than 1 to 5 Wt. % or higher. It is generally in the range from 0.5 to 1% Wt. %. Pre-combustion separation of iron pyrite will lower the sulfur oxide concentration in the combustion products which must be scrubbed and, perhaps more importantly, will reduce the amount of reactive iron sulfides at the water wall when low nitrogen oxide ($NO_x$) burners are used. Water wall wastage is related to reactive iron sulfides produced when iron pyrite is burned in low $NO_x$ burners. The resulting sulfides migrate to the boiler walls and release sulfur which is very corrosive under the reducing conditions.

There are many trace metals in coal. Each can range from parts per billion based on the weight of coal to thousands of parts per million. Of the trace metals, mercury, arsenic, and selenium are of particular interest because they are considered hazardous air pollution precursors (HAPS). Mercury is of particular interest because of the emissions restriction anticipated, less than 1 pound of mercury per $10^{13}$ Btu or approximately 1 pound of mercury $10^9$ pounds of coal, and the difficult and cost of removal from flue gases, of the order of $20,000 per pound of mercury. With mercury levels typically 100 pounds per billion pounds of coal, very high efficiencies of removal will be required. Arsenic is of additional interest because this trace metal poisons catalytic reactors used for separation of nitrogen oxides from the combustion off gases. Catalyst replacement is very expensive.

Particles entering at 4 drop into the base of the pulverizer 207 where they are ground by being caught between the ring 201 and roller 202 mechanism. Particles are thrown in all directions by the energy release in the grinding event. The plow 206 revolves through the mass of particles in the base and moves these particles into the region between ring and roller. Large particles which strike the walls of the grinding chamber 200 fall back into the base of the mill where they are forced into the grinding mechanism again. Air 5 is blown into the base of the mill through air scroll casing 18. The upward swirl of air 2002 conveys particles in a swirling motion out of the grinding zone. Some particles are thrown outward against the inside wall of the pulverizer and fall back into the base of the mill where they undergo additional grinding. Small particles are conveyed upward in the pulverizer by the air flow 2002 and enter the classifier 2003 through vanes 402 at the top of the mill. The smallest particles are conveyed with the air flow out of the pulverizer at 6. Oversize particles which enter the classifier through vanes 402 are returned to the base of the mill through flap valves 403 at the base of the classifier.

A portion of the particles which are intermediate in size between that of the feed to the pulverizer and the product and which are in the base of the mill or are in motion above the grinding zone are removed from the inside of the mill through removal mechanisms 7, 8, 9, and 10. Mechanism 7 is a screw conveyor. Referring now to FIG. 2, the mechanism 7 is shown passing through the air casing wall 18 and enters into the base of the mill 207 through the an opening in air flow vane 208. The end of the screw conveyor is open to particles. The air flow vane slot upstream of the vane 208 is closed thus making a buildup of particles at the vane 208. These particles are removed by the screw conveyor and can be discharged to the reject stream 17 directly when the quality of the particles does not warrant processing with separation mechanism 2 or transported to the separation mechanism 2 via the screw conveyor 11.

Particles colliding with or moving near the walls of the grinding chamber 200 are removed from the pulverizer through separation mechanism 8 mounted on the wall of the grinding chamber. There may be more than one such separation mechanism and they may be mounted at various elevations above the top of the grinding zone in the base of the mill 207. The separation mechanism 8 opens into the mill through a hinged door which can be directed to catch particles which are rising, falling, or moving around the circumference of the mill in either clockwise or counterclockwise direction. An air-jet mechanism 615 can be used to prevent excess amount of fine material from being withdrawn from the mill. This is accomplished by directing the air jet into the mill through the opening for mechanism 8. The coarse particles which are deflected into the separation mechanism fall through an airlock mechanism which serves to isolate the atmosphere inside the mill. The mill can be of the overpressure or the under-pressure type. Particles exiting mechanism 8 can be discharged to the reject stream 17 directly when the quality of the particles does not warrant processing with separation mechanism 2 or conveyed to the separation mechanism 2 via conveyor 11. This conveyor can be a screw conveyor, a belt conveyor, elevator or any method for moving the particles in the minus 8 mesh size fraction.

Particles which are falling along the inside wall of the outside casing of the classifier are removed from the pulverizer circulation by separation mechanism 9. More than one such mechanism may be employed and they may be mounted at any elevation below the entrance to the classifier at the top of the mill. This mechanism may be arranged to catch particles rising, falling, or with a vortex motion in either direction around the inside wall of the classifier casing. Preferentially, it is arranged to catch particles falling back to the grinding zone. An air jet mechanism 615 similar to that described above can be used to prevent an excess of small particles from exiting the mill. The mechanism and the means to convey to the separation mechanism 2 or to the reject stream 2 are similar to that of separation mechanism 8.

A portion of the oversize particles exiting the bottom of the classifier cone through flap valves 403 are conveyed through screw conveyor 10. They can be discharged to the reject stream 17 directly when the quality of the particles does not warrant processing with separation mechanism 2 or to the conveyance mechanism 11. These particles are close to final particle size but have been recycled by the classifier because of their mass. They do not have excess ash and sulfur to the extent that oversize particles do which are low inside the pulverizer. The proportion of these particles which are separated from the mill will be dependent upon the necessity for complete treatment in the separation mechanism. Generally, this stream may be neglected or treated only in small quantity.

Particles withdrawn from the pulverizer are conveyed 11. They can be discharged to the reject stream 17 directly when the quality of the particles does not warrant processing with separation mechanism 2 or to the storage bin 20 at the input to the separation mechanism 2. Particles are discharged from bin 20 to the size classification means 12 which, for this example, is a screen. The undersize particles, generally smaller than 8 mesh, are discharged to vibratory feeder 100. The oversize particles 15 can be conveyed either to the pulverizer for additional grinding 16 or conveyed to reject 17 depending upon the quality of the particles. The product of the separation mechanism is returned to the pulverizer 16 for grinding to size specification. The reject from the separation mechanism is conveyed to refuse 17.

The vibratory feeder 100 serves to convey the undersize particles to the belt separator 801 and to electrically charge the particles by friction and contact. The material surface of the vibratory feeder is preferentially an electrical conductor which has a work function which is intermediate between the two major types of particles to be separated. For coal, copper is preferred. In contact with copper, the hydrocarbon component of coal will lose an electron to the copper and become positively charged. The inorganic particles to be separated will generally acquire the electron from the copper and become negatively charged. In addition to serving as an intermediary in the transfer of charge, the copper is an electrical conductor and this facilitates the charge transfer. The copper and inorganic particles do not have to be in direct contact to transfer the charge. The particles can also transfer charge by direct contact.

The vibratory tray is also used to set the rate at which particles are issued to the belt separator. This is controlled by the motor action of the tray feeder.

Particles issuing from the vibratory feeder fall onto belt 801 which carries the particles to the magnetic separator 803. Further electric charging can occur as the particles contact the belt. Electric charge can be imparted to the particles. The belt is electrically common with the surface of the permanent magnet 803. Triboelectric charging can occur when the particles skid on the surface of the belt. Skidding occurs when the horizontal component of the velocity of the particles falling from the vibratory tray feeder is different from that of the moving belt. The belt material may be made from insulating or conducting materials and may have iron fibers implanted which will enhance the magnetic field gradient at the surface of the magnetic separator 803. The preferred belt is an antistatic belt which prevents buildup of electric charge on the belt. This is a belt of the type manufactured by Taconic of Petersburgh, N.Y.

A scalping magnetic separator 802 is suspended just above the belt surface at the exit of the vibratory tray feeder. This separator removes very strongly ferromagnetic particles from the stream of particles and prevents these particles from entering the first magnetic separator 803.

An electrode 809 is suspended above the surface of the magnetic separator 803. A potential is applied to the electrode by source 810. The polarity of this electrode is chosen to be opposite of that of the surface of the magnetic separator which is grounded. For processing coal, the electrode is negative with respect to the surface of the magnetic separator. The electric field is directed from the surface of the magnet to the electrode. In this fashion, positively charged carbon rich particles are attracted to the electrode and repelled by the magnetic separator. Likewise, the minerals in coal are negatively charged and are attracted by both magnetic and electric forces to the surface of the magnetic separator. The electrode can be placed so as to support the separation. It can be at the end of the belt in front of the magnetic separator or can be at any angle with respect to the horizontal from 0 degrees to 90 degrees. It must be placed far enough away from the surface of the belt so that particles which are lifted off the belt and deflected outward can reach the appropriate collector without hitting the electrode. Particles which hit the electrode can be discharged and recharged so that they are driven back to the surface of the magnetic separator. This is undesirable. Potentials can be applied up to the breakdown strength of air.

Particles are thrown off of the belt separator 13 depending upon the balance of forces on the particles. First, any particle with an electric charge will have a mirror charge in the surface of the magnetic separator if the surface of the separator is an electrical conductor. This results in an electric field which can be directed away from the surface or toward it depending upon the sign of the charge on the particles. Nonetheless, the resulting attractive force is always toward the surface of the magnet. Next, the applied electric field at the surface of the separator is directed normal to the surface and away from it. The net electric field is the vector sum of the mirror field and the applied field. Negatively charged paramagnetic particles will be attracted to the belt while positively charged diamagnetic particles will be repelled if the applied field is greater than the mirror field.

The inertial force of rotation of the magnet is directed away from the magnet surface. Gravity is everywhere directed downward. A component of gravity directed toward the magnet surface will add to the attractive force in the upper 90 degrees of the motion around the end of the magnet and will subtract in the bottom portion of the arc. Once the particles leave the surface, air drag will tend to drag the particles into the magnetic fraction. The drag force will be greatest on the smallest particles in the stream. This is not expected to be important for particles generally greater than 100 mesh.

Negatively charged particles which are the most magnetic will travel around the arc of the first magnetic separator and will leave the belt underneath and away from the separator. They will generally have negative electric charges greater than $-10^{-5}$ coulombs/kg and magnetic susceptibilities greater than $10–50*10^{-9}$ $m^3$/kg. They will exit the first separator at 804.

Positively charged particles which are diamagnetic or the least magnetic will be thrown from the belt early in its travel around the magnet pulley. For coal, these particles will have magnetic susceptibilities generally less than $10^{*-9}$ $m^3$/kg and may have electric charges generally greater than $+10^{-5}$ coulombs/kg. They will exit the first separator at 806.

All other particles which have weak or no electric charge, generally between $-10^{-5}$ and $+10^{-5}$ coulombs/kg, and which are diamagnetic or very weakly paramagnetic with susceptibilities generally less than $10–30*10^{-9}$ $m^3$/kg, will fall or be thrown from the belt near the leading edge of the magnetic pulley. They will exit the first magnetic separator at 805.

The particles exiting at 804 constitute the reject or refuse fraction. Those exiting at 806 are of product quality. The other particles exiting at 805 are of intermediate quality. They can be reprocessed in the second stage electromagnetic separator 14 depending upon needs.

Particles exiting the first electric and magnetic separation means at 805 fall into catch basin 101 which feeds the particles to the second magnetic separation device 14. Referring now to FIG. 10, basin 101 is an elongate bin with sloping sides. The bottom is divided along its length 1001 to separate the particles into two groups of equal mass. The particles in each of the two groups are fed through elongate rectangular openings 1002 spaced periodically along the bottom of the bin and aligned with openings of similar size in a manifold palate 1100 mounted on the top of the magnetic separation matrix 1200 located inside the working volume of the transverse access electromagnet. The bin serves to capture surges in the flow and to provide a uniform feed to the magnetic separator.

The manifold plate 1100 has two columns of elongate rectangular openings for admitting coal from the basin 101 into the open space shown in FIG. 15 between flux convergers 1203 and the poles 1202 of the magnetic matrix 1200. The coal stream 1806 entering the void space has a rectangular shape.

Referring now to FIG. 15, there is shown a plan view of a magnetic matrix 1200 which consists of two columns of poles which columns are divided into groups of four pole pairs each. Particles are introduced at the top of the matrix into the rectangular regions 1806 between poles and fall along the length of the poles to an exit at the bottom. The pole length is chosen to give sufficient residence time for separation which occurs in the plane of the figure. For processing coal, the pole length can be from 4 inches to 12 inches and is preferentially 9 inches. The residence time for particles falling through the matrix is a fraction of a second.

The weakly paramagnetic or diamagnetic particles in the stream of particles entering at 1806 are pushed by magnetic forces outward into the regions 1802 where the magnetic field strength is lowest. Paramagnetic particles are attracted and trapped in the regions 1803 near the pole tips. The magnetic force is sufficient to separate the particles but not strong enough for particles exiting the first electric and magnetic separator at 805 to stick to the poles in the magnetic separator 14. The particles which pass generally have magnetic susceptibilities less than about $5*10^{-9}$ $m^3$/kg.

Shown in FIG. 15 are magnetic rods 1805 which are affixed to the faces of the poles 1801. The rods serve to increase the local magnetic field in the region immediately adjacent the pole tips. This has the effect of reducing the volume between poles in which the magnetic force is small. Preferentially, the diameter of the steel rod is 1% to 10% of the diameter of the matrix pole and more preferentially 6%.

By way of example, when the pole tip diameter is 25.4 mm and the width of pole gap is 8 mm, each pair of pole tip/convergers is capable of processing nominally 100 pounds of the weakly magnetic fraction of mill concentrated coal per hour. The matrix shown in FIG. 15 has four such pole tip/converger pairs between each divider 1204. Each of these groups handles nominally 400 pounds coal per hour. There are five groups in the matrix of FIGS. 11 and 15 so the matrix is capable of handling about 1 ton of the weakly magnetic fraction of mill concentrated coal per hour when fully magnetized. This equates to a throughput of 13.6 tons of the weakly magnetic fraction of the mill concentrated coal per hour per square foot of available magnetized area transverse to the flow. By way of comparison, large high gradient magnetic separators used in processing slurries containing 30 percent by weight of kaolin clay produce about 1.4 tons dry kaolin per hour per square foot of available magnetized area transverse to the flow.

As the coal particles accelerate downward through the open region between poles shown in FIG. 15 the diamagnetic particles will be pushed laterally into the regions of low magnetic field strength and the paramagnetic particles will be forced into the region of narrowest pole opening. The pole length must be great enough to accomplish the separation. This length has been determined to be 4 inches to 10 inches and preferably 9 inches when processing the weakly magnetic fraction of mill concentrated coal particles.

In the bottom portion of FIG. 15 is shown a top view of knife edge splitters 1901 located underneath the bottom of the matrix 1200. These splitters divide the stream of particles exiting the magnetic separator into separate streams based on the magnetism of the particles. The splitters can be adjusted as shown in FIG. 16 so as to vary the area open between each.

Referring now to FIG. 16, a splitter mechanism 1900 of the type described in U.S. Pat. No. 5,017,283 (May 21, 1991), incorporated by reference herein, is shown in exploded view. Each splitter 1901 is hinged at the bottom so that it can be rotated from the vertical. In this way, the top opening between vanes can be adjusted individually or collectively. The bottom opening between hinges 1902 is fixed and is approximately ¼ of the width of each pole pair which is twice the diameter of the poles 1801.

The particles collected in adjacent openings 1903 between splitters have different magnetic susceptibilities. Referring now to FIG. 15, each opening for collection of diamagnetic particles 1850 will be sandwiched between two openings for collection of paramagnetic particles 1860, except at the opposite ends of the magnetic matrix, each of which will collect diamagnetic particles.

Particles exiting at the bottom of splitter 1901 fall directly into chute mechanism 1904. Each segment 1906 of this mechanism has a ramp 1907 which directs the falling particles laterally out of the separator through holes 1905. The ramp in each adjacent segment is sloped oppositely so that all particles of like magnetism exit the separator on the same side. Paramagnetic particles will be on one side and diamagnetic particles will be on the other.

The weakly magnetic particles exiting the first electric and magnetic separator at 806, the diamagnetic particles exiting the second magnetic separator at 815, the paramagnetic particles exiting the second magnetic separator at 813, and the strongly magnetic particles exiting the first electric and magnetic separator at 804 can each be collected separately or can be combined as desired.

FIG. 17 and the description which follows it illustrates a preferred embodiment of this invention. It is not restricted to pulverizing coal but can be used to improve the properties of any material for which size reduction will liberate the particle components and for which the size reduction mechanism serves also to concentrate one fraction while the separator mechanism serves to separate one fraction. The air-swept pulverizer used for illustration is of the ring/roller type such as that manufactured by Bradley Pulverizer Company of Allentown, Pa. While the grinding mechanism employed is that of a ring/roller mill, all other mills for which particles circulating inside the mill can be accessed, such as hammer mills and roller mills, can be used. The classifier oversize material which is returned to the grinding zone from pulverizers such as ball mills can also be treated by the method of this invention. The method described above can be used in pulverizers employing under pressure or over pressure. Further the preferred separator means including size classification and magnetic separation are illustrative of the invention and are not intended to be limiting. Other mean of separation can be employed such as size classification alone, or magnetic and electric separation, cyclones, air tables, etc.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for providing coal of a desired particle size comprising the steps of:

producing a first stream of grindable particles and at least a second stream of particles with Hardgrove grindabilities at least 10% less than that of the first stream with a pulverizer;

directing the first stream away from the pulverizer to a first location;

directing the second stream to a separation mechanism apart from the first location to further sort the second stream; and returning to the pulverizer a desirable component separated from the second stream and rejecting an undesirable component.

2. A method as described in claim 1 wherein the producing step includes the step of concentrating the particles with Hardgrove grindabilities at least 10% less than that of the feed particles in the pulverizer.

3. A method as described in claim 2 wherein the producing step includes the step of producing the first stream primarily of coal of the desired particle size and producing the second stream primarily of ash-forming minerals.

4. A method as described in claim 3 wherein after the second stream directing step, there is the step of returning the coal of low ash and low sulfur produced by the separation mechanism back to the pulverizer.

5. A method as described in claim 4 wherein the ash-forming minerals include iron pyrite.

6. A method as described in claim 5 wherein the producing step includes the step of introducing air flow with a blower into the pulverizer.

7. A method as described in claim 6 wherein the second stream directing step includes the step of rejecting directly all the particles in the second stream.

8. A method as described in claim 7 wherein the producing a second stream step includes the step of screening coarse particles from the stream of less grindable particles separated from the pulverizer.

9. A method as described in claim 8 wherein the producing step includes the step of producing the first stream primarily of coal of the desired particle size and producing the second stream primarily of minerals including mercury, arsenic and selenium.

* * * * *